US010855057B2

(12) United States Patent
Wakasugi et al.

(10) Patent No.: US 10,855,057 B2
(45) Date of Patent: Dec. 1, 2020

(54) SPARK PLUG FOR INTERNAL COMBUSTION ENGINE

(71) Applicant: DENSO CORPORATION, Kariya (JP)

(72) Inventors: Ryota Wakasugi, Nisshin (JP); Fumiaki Aoki, Nisshin (JP); Daisuke Tanaka, Nisshin (JP); Akimitsu Sugiura, Kariya (JP); Tetsuya Miwa, Kariya (JP); Kanechiyo Terada, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/520,392

(22) Filed: Jul. 24, 2019

(65) Prior Publication Data

US 2020/0036165 A1 Jan. 30, 2020

(30) Foreign Application Priority Data

Jul. 25, 2018 (JP) ..... 2018-139760

(51) Int. Cl.
*H01T 13/20* (2006.01)

(52) U.S. Cl.
CPC ..... *H01T 13/20* (2013.01)

(58) Field of Classification Search
CPC ..... H01T 13/20
See application file for complete search history.

(56) References Cited

U.S. PATENT DOCUMENTS 4,487,177 A * 12/1984 Ishikawa ..... H01T 13/467 123/143 B
4,695,758 A * 9/1987 Nishida ..... H01T 13/467 313/130
4,910,428 A * 3/1990 Strumbos ..... H01T 13/20 313/136
5,731,654 A 3/1998 Benedikt et al.
5,950,584 A * 9/1999 Bubeck ..... H01T 13/52 123/169 E
2016/0072259 A1* 3/2016 Kinoshita ..... H01T 13/52 313/141
2016/0276810 A1* 9/2016 Chiera ..... H01T 13/06
2017/0276114 A1 9/2017 Kinoshita et al.

FOREIGN PATENT DOCUMENTS

JP H07-074631 8/1995
JP 2016-062769 4/2016
JP 2017-190677 10/2017

* cited by examiner

*Primary Examiner* — Donald L Raleigh
(74) *Attorney, Agent, or Firm* — Nixon & Vanderhye P.C.

(57) ABSTRACT

In a spark plug for an internal combustion engine, a cylindrical insulator is arranged radially inside a cylindrical ground electrode, and includes an insulator protruding portion protruding further toward a distal end side in an axial direction than a distal end of the ground electrode. A center electrode is held radially inside the insulator, and includes an exposed portion exposed from a distal end of the insulator protruding portion. The spark plug generates a discharge from the exposed portion to the ground electrode, in a discharge gap formed along a surface of the insulator protruding portion. At least one of the exposed portion and the insulator protruding portion includes a flow inlet that is open on an outer circumferential surface thereof, a flow outlet that is open toward the discharge gap, and a communication passage communicating between the flow inlet and the flow outlet.

15 Claims, 30 Drawing Sheets

SPARK PLUG FOR INTERNAL COMBUSTION ENGINE

CROSS-REFERENCE TO RELATED APPLICATION

This application is based on and claims the benefit of priority from Japanese Patent Application No. 2018-139760, filed Jul. 25, 2018. The entire disclosure of the above application is incorporated herein by reference.

BACKGROUND

Technical Field

The present disclosure relates to a spark plug for an internal combustion engine.

Related Art

For example, a spark plug that generates a discharge between a ground electrode and a center electrode as a result of a high-frequency voltage being applied to the center electrode is known as a spark plug for an internal combustion engine in the prior art. The spark plug in the prior art generates a creeping spark discharge between the center electrode and the ground electrode. The creeping spark discharge creeps along an outer circumferential surface of an insulator.

SUMMARY

The present disclosure provides a spark plug for an internal combustion engine that includes a cylindrical ground electrode, a cylindrical insulator, and a center electrode. The spark plug generates a discharge from an exposed portion of the center electrode to the ground electrode, in a discharge gap that is formed along a surface of an insulator protruding portion of the insulator. At least one of the exposed portion of the center electrode and the insulator protruding portion of the insulator includes a flow inlet, a flow outlet, and a communication passage between the flow inlet and the flow outlet.

DESCRIPTION OF THE EMBODIMENTS

Figure 1:
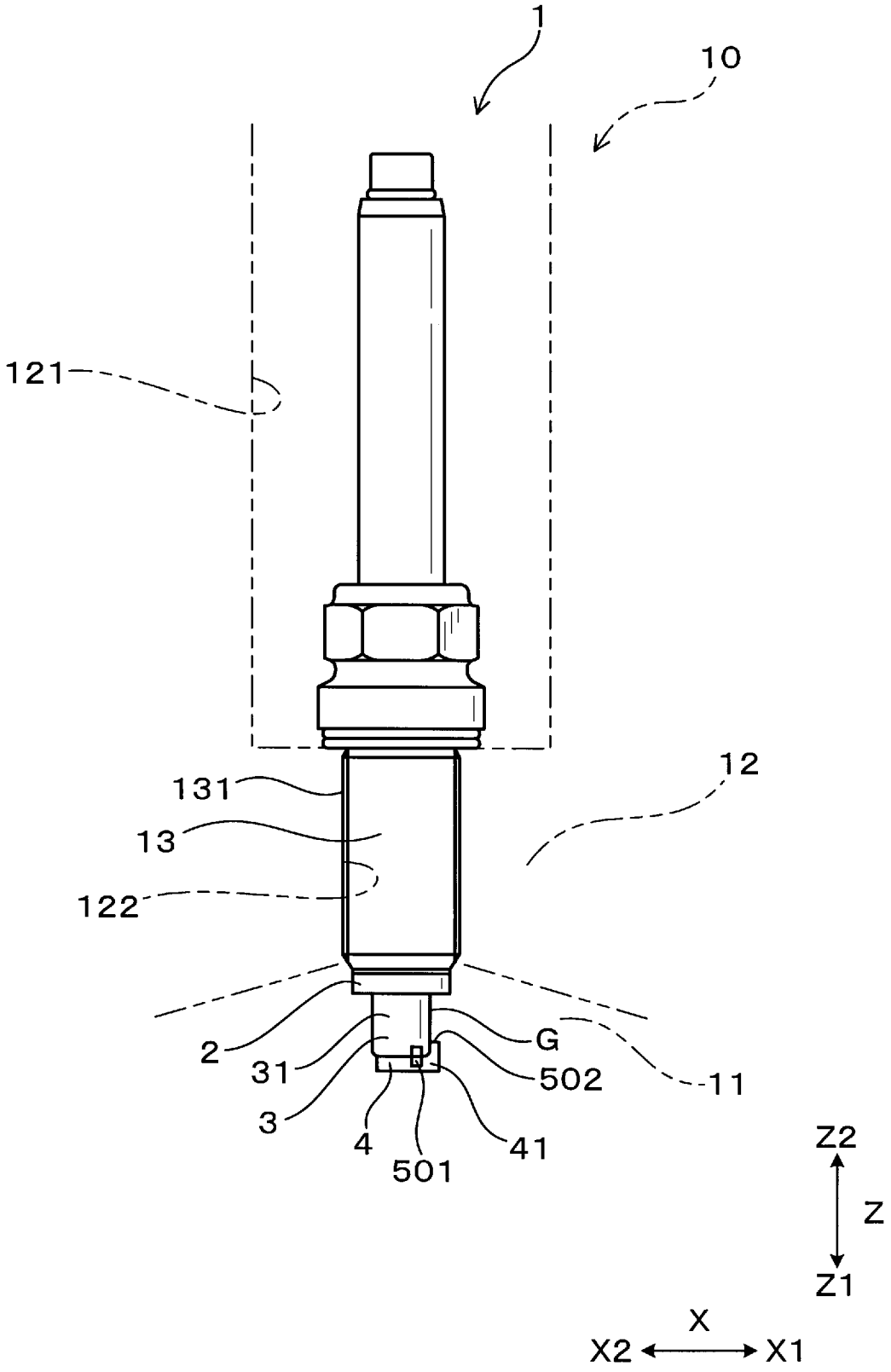
FIG. 1 is a front view of a spark plug according to a first embodiment.

In the spark plug in the prior art, airflow inside a combustion chamber tends to flow in a direction along the outer circumferential surface of the insulator (that is, a circumferential direction of the spark plug). As a result, a discharge spark that is generated such as to creep along the outer circumferential surface of the insulator tends to be pushed by the airflow that flows in the circumferential direction of the spark plug and stretched along the outer circumferential surface of the insulator.

When the discharge spark remains present along the surface of the insulator in this manner, cooling loss that occurs as a result of heat from a flame that is generated in an air-fuel mixture by the discharge spark being drawn to the insulator and the like increases. Therefore, the flame that is generated by the spark discharge is difficult to grow, and improvement in the ignition reliability (ignitability) of the spark plug becomes difficult to achieve.

It is thus desired to provide a spark plug for an internal combustion engine that is capable of improving ignition reliability.

An exemplary embodiment provides a spark plug for an internal combustion engine that includes: a cylindrical ground electrode; a cylindrical insulator that is arranged radially inside the ground electrode and includes an insulator protruding portion that protrudes further toward a distal end side in a plug axial direction that a distal end of the ground electrode; and a center electrode that is held radially inside the insulator and includes an exposed portion that is exposed from a distal end of the insulator protruding portion.

The spark plug is configured to generate a discharge from the exposed portion of the center electrode to the ground electrode, in a discharge gap that is formed along a surface of the insulator protruding portion. At least one of the exposed portion and the insulator protruding portion includes: a flow inlet that is open on an outer circumferential surface of the at least one of the exposed portion and the insulator protruding portion; a flow outlet that is open toward the discharge gap; and a communication passage that communicates between the flow inlet and the flow outlet.

In the spark plug for an internal combustion engine according to the exemplary embodiment, at least one of the exposed portion and the insulator protruding portion includes the flow inlet that is open on the outer circumferential surface of the at least one of the exposed portion and the insulator protruding portion, the flow outlet that is open toward the discharge gap, and the communication passage that communicates between the flow inlet and the flow outlet. Therefore, airflow inside a combustion chamber flows into the communication passage from the flow inlet and is discharged toward the discharge gap from the flow outlet. As a result, a discharge spark that is generated in the discharge gap is pushed (blown) by the airflow that flows out from the flow outlet and is pulled away from an outer circumferential surface of the insulator protruding portion of the insulator at an early stage.

As described above, according to the exemplary embodiment, a spark plug for an internal combustion engine that is capable of improving ignition reliability can be provided.

First Embodiment

A spark plug for an internal combustion engine according to a first embodiment will be described with reference to FIG. 1 to FIG. 15

As shown in FIG. 1 to FIG. 4, a spark plug 1 for an internal combustion engine according to the present embodiment includes a cylindrical ground electrode 2, a cylindrical insulator 3, and a center electrode 4. The insulator 3 is arranged radially inside the ground electrode 2. In addition, the insulator 3 has an insulator protruding portion 31 that protrudes further toward a distal end side in a plug axial direction Z than a distal end of the ground electrode 2. The center electrode 4 is held radially inside the insulator 3. Furthermore, the center electrode 4 has an exposed portion 41 that is exposed on an outer side of the insulator 3 from a distal end of the insulator protruding portion 31.

As shown in FIG. 1 to FIG. 4, the spark plug 1 for an internal combustion engine according to the present embodiment is configured such that a discharge is generated in a discharge gap G. The discharge gap G is formed along a surface of the insulator protruding portion 31, from the exposed portion 41 of the center electrode 4 to the ground electrode 2.

Figure 2:
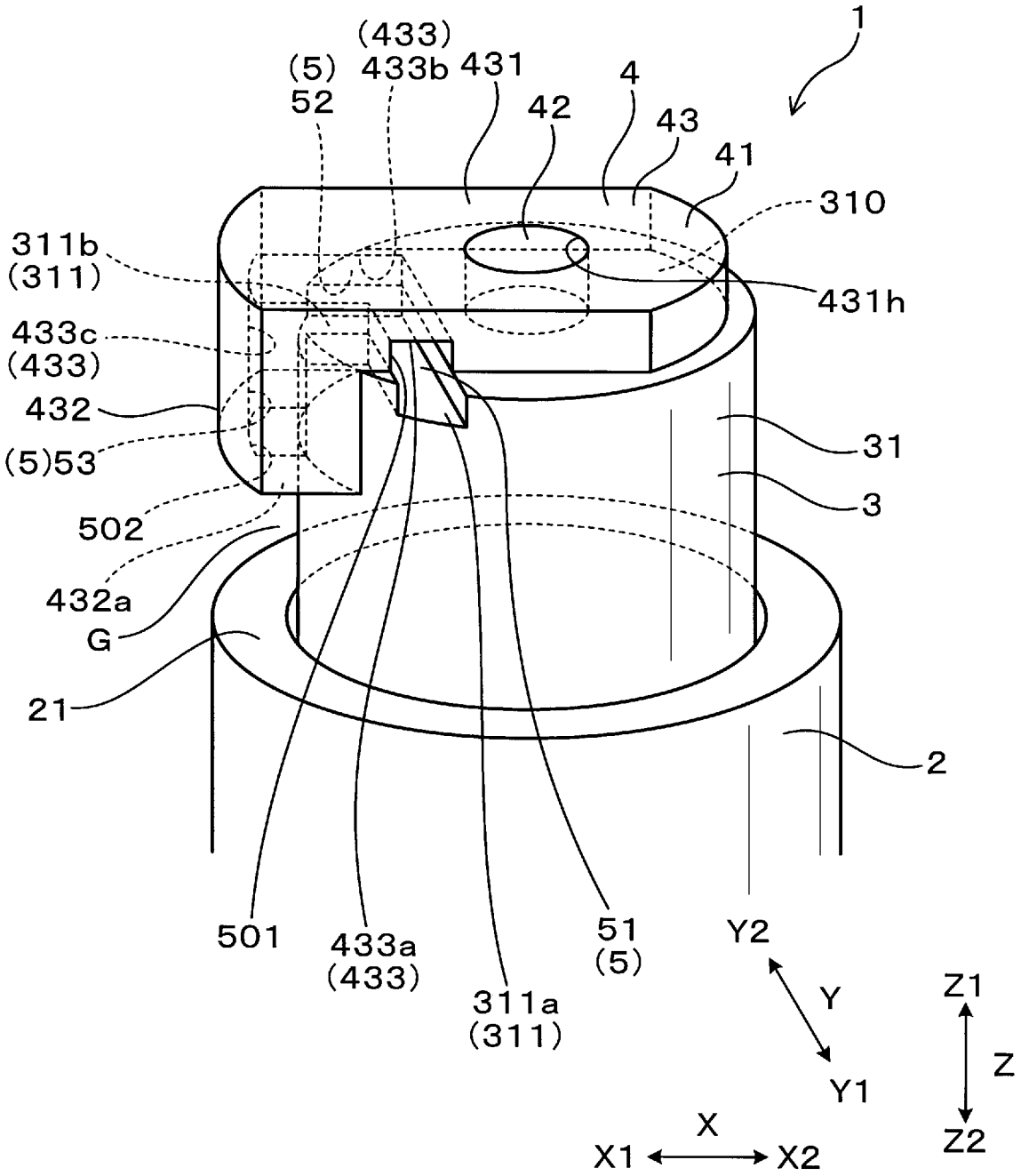
FIG. 2 is a perspective view of a distal end portion of the spark plug according to the first embodiment.
Figure 3:
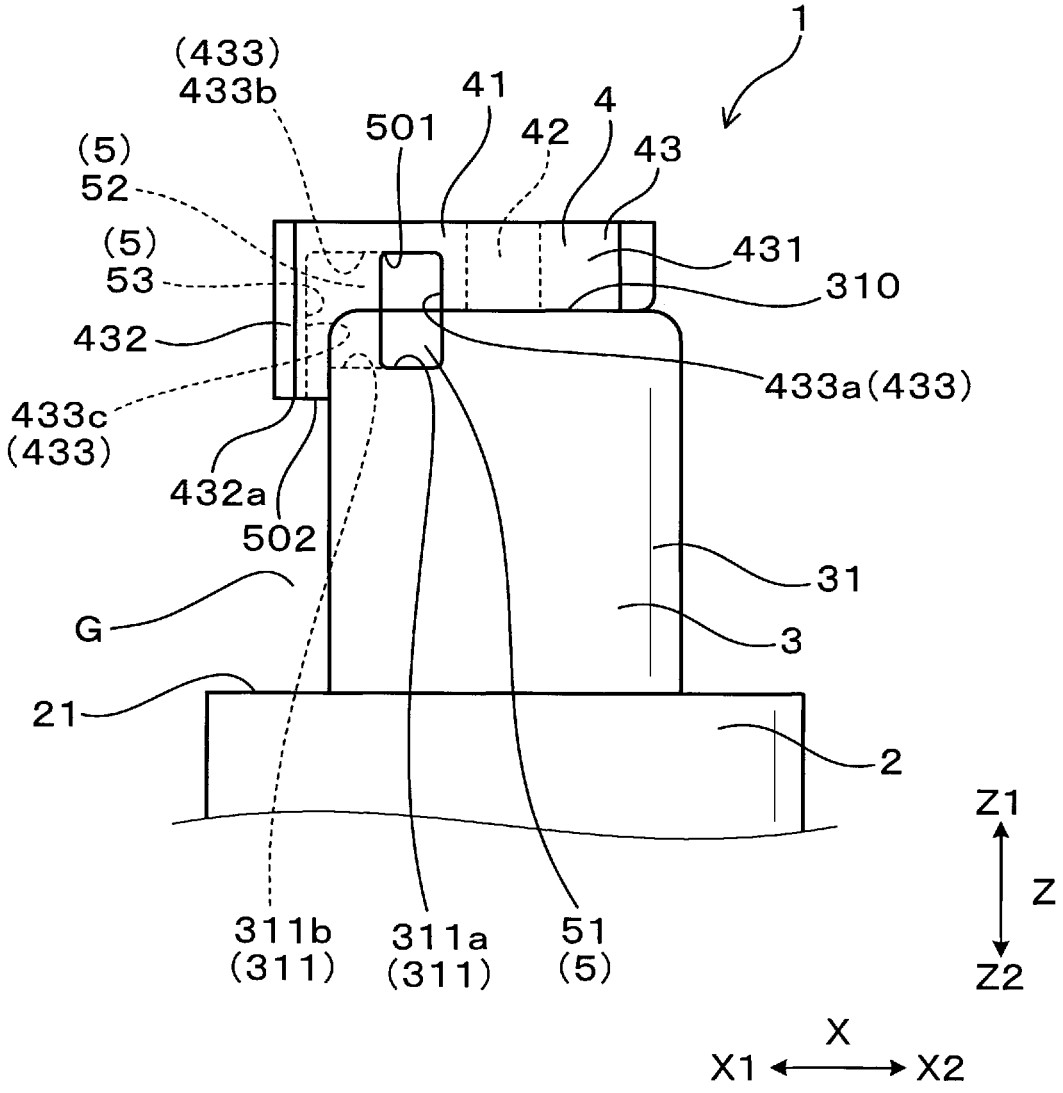
FIG. 3 is a front view of the distal end portion of the spark plug according to the first embodiment.
Figure 4:
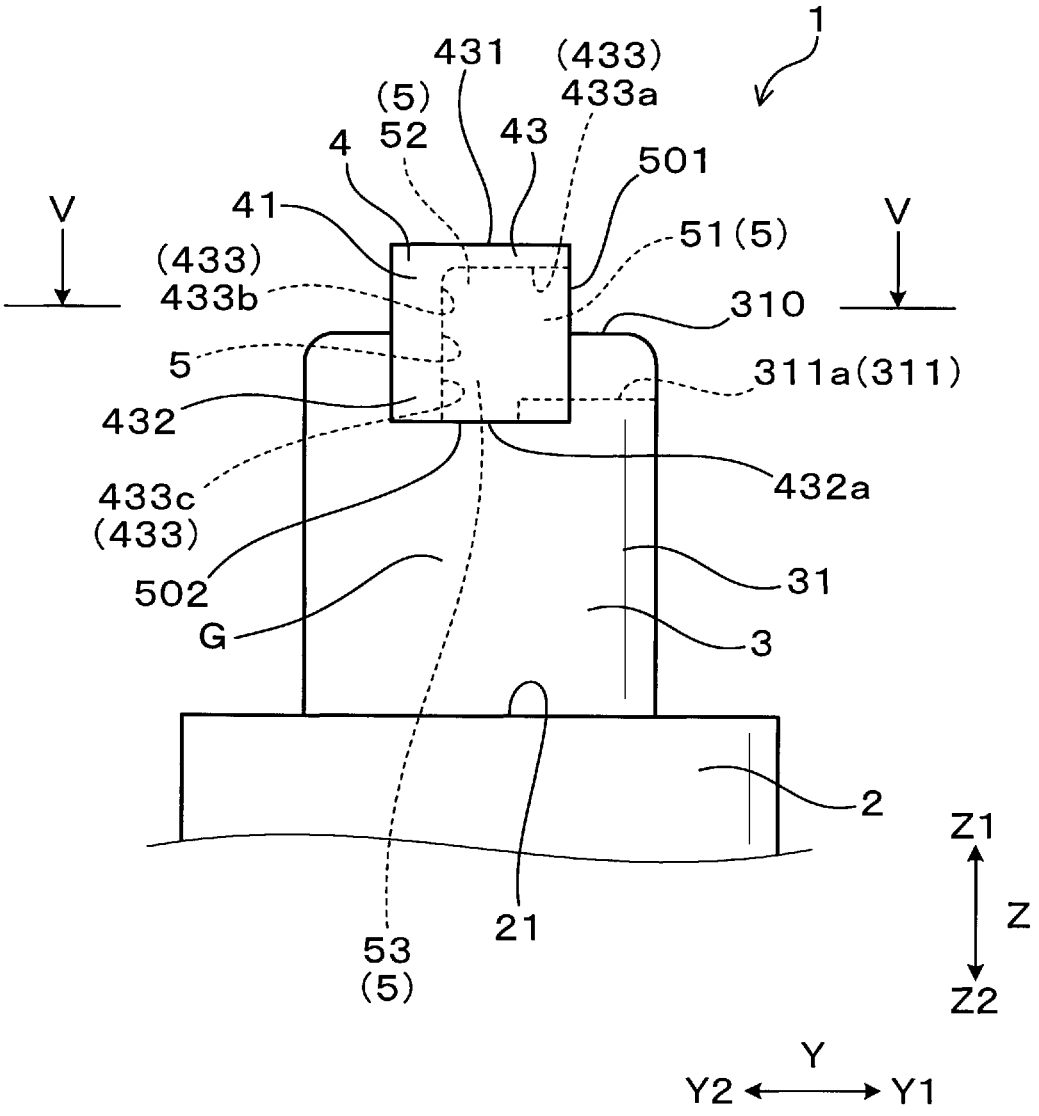
FIG. 4 is a side view of the distal end portion of the spark plug according to the first embodiment.

In addition, as shown in FIG. 2 to FIG. 4, at least one of the exposed portion 41 and the insulator protruding portion 31 includes a flow inlet 501, a flow outlet 502, and a communication passage 5. The flow inlet 501 is open on an outer circumferential surface of at least one of the exposed portion 41 and the insulator protruding portion 31. The flow outlet 502 is open toward the discharge gap G, and a communication passage 5. The communication passage 5 communicates between the flow inlet 501 and the flow outlet 502. Here, in FIG. 2 and FIG. 4, an outer shape of the communication passage 5 is shown by broken lines. Details according to the present embodiment will be described below.

In the present specification, a plug center shaft refers to a center shaft of the spark plug 1. The plug axial direction Z refers to a direction in which the plug center shaft extends. A plug radial direction refers to a radial direction of the spark plug 1. A plug circumferential direction refers to a circumferential direction of the spark plug 1.

For example, the spark plug 1 according to the present embodiment can be used as an ignition means in an internal combustion engine for a vehicle, such as an automobile. The spark plug 1 is connected to a high-voltage power supply unit (not shown) on one end side in the plug axial direction Z. The spark plug 1 is arranged inside a combustion chamber 11 of the internal combustion engine on the other end side, as shown in FIG. 1. For example, the high-voltage power supply unit can be a power supply for an ignition apparatus that is capable of continuous control of discharge, or a high-frequency power supply that is capable of applying a high-frequency voltage of 200 kHz to 5 MHz to the center electrode 4.

Here, in the present specification, a side that is one side in the plug axial direction Z and a side toward which the spark plug 1 is inserted into the combustion chamber 11 is a distal end side (tip end side). A side opposite the distal end side is a proximal end side (base end side). The distal end side in the plug axial direction Z may be referred to as a Z1 side. The proximal end side in the plug axial direction Z may be referred to as a Z2 side.

Figure 5:
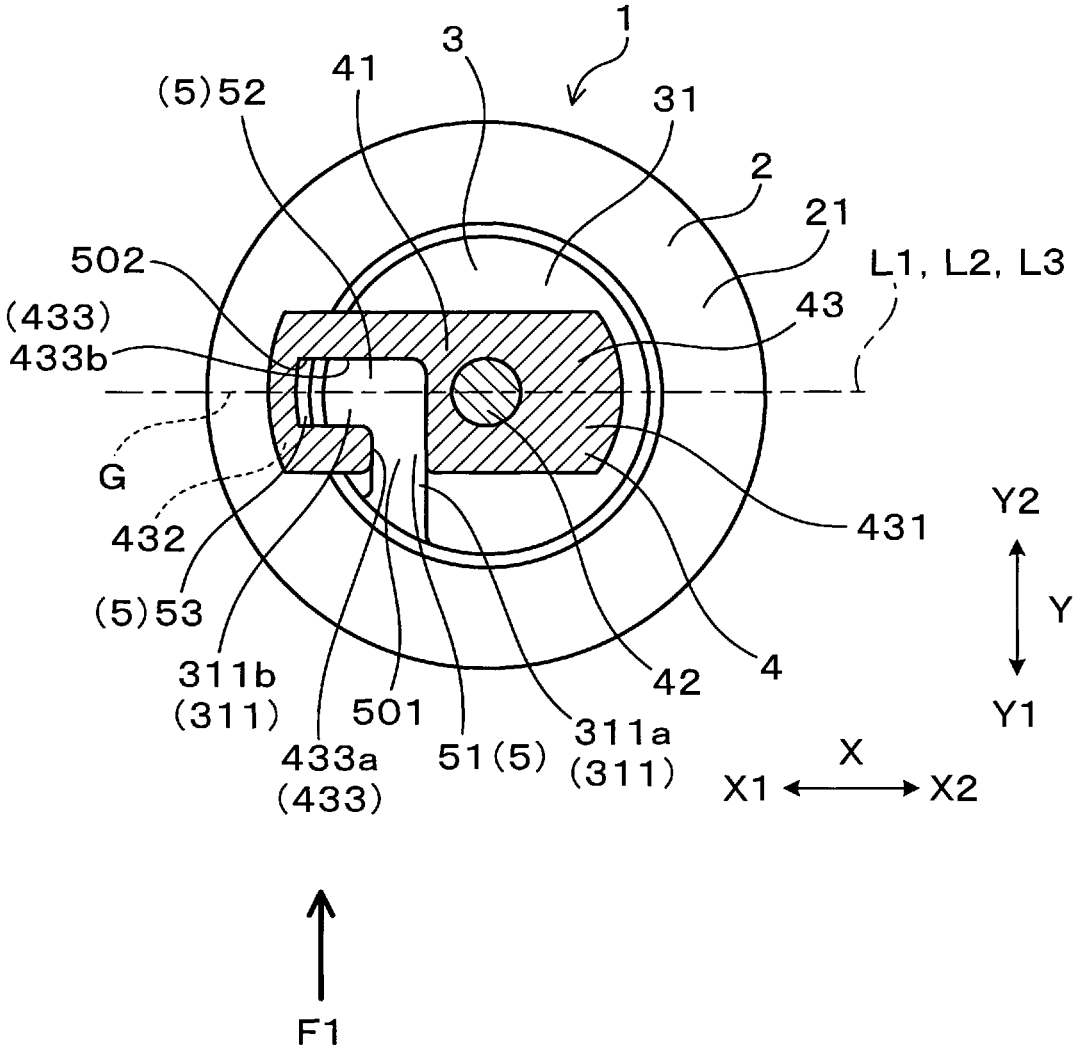
FIG. 5 is a cross-sectional view taken along line V-V in FIG. 4.

As shown in FIG. 1 to FIG. 5, the ground electrode 2 has a cylindrical shape. The ground electrode 2 is formed such as to surround the overall circumference of the insulator 3. As shown in FIG. 2 and FIG. 5, a distal end surface 21 of the ground electrode 2 has an annular shape. The distal end surface 21 of the ground electrode 2 is perpendicular to the plug axial direction Z. The overall distal end surface 21 of the ground electrode 2 is formed such as to be flush on a plane that is perpendicular to the plug axial direction Z. An angle between the distal end surface 21 and an inner circumferential surface of the ground electrode 2 is a right angle. In addition, an angle between the distal end surface 21 and an outer circumferential surface of the ground electrode 2 is also a right angle.

As shown in FIG. 1, the ground electrode 2 is provided such as to extend from a distal end of a housing 13 toward the Z1 side. The housing 13 has a cylindrical shape. An attachment screw portion 131 is formed on an outer circumferential surface of the housing 13. The attachment screw portion 131 is provided such as to be screwed into a female screw hole 122 that is provided in a plug hole 121 of an engine head 12. The ground electrode 2 is joined on the Z1 side of a portion of the housing 13 in which the attachment screw portion 131 is provided. Here, the ground electrode 2 and the housing 13 may be configured as an integrated component. The housing 13 holds the insulator 3 on an inner side thereof.

As shown in FIG. 1, a center portion of the insulator 3 in the plug axial direction Z is arranged on the inner sides of the housing 13 and the ground electrode 2. A proximal end portion of the insulator 3 protrudes further toward the Z2 side than the housing 13. The insulator protruding portion 31 that is a distal end side of the insulator 3 protrudes further toward the Z1 side than the distal end surface 21 of the ground electrode 2.

Figure 6:
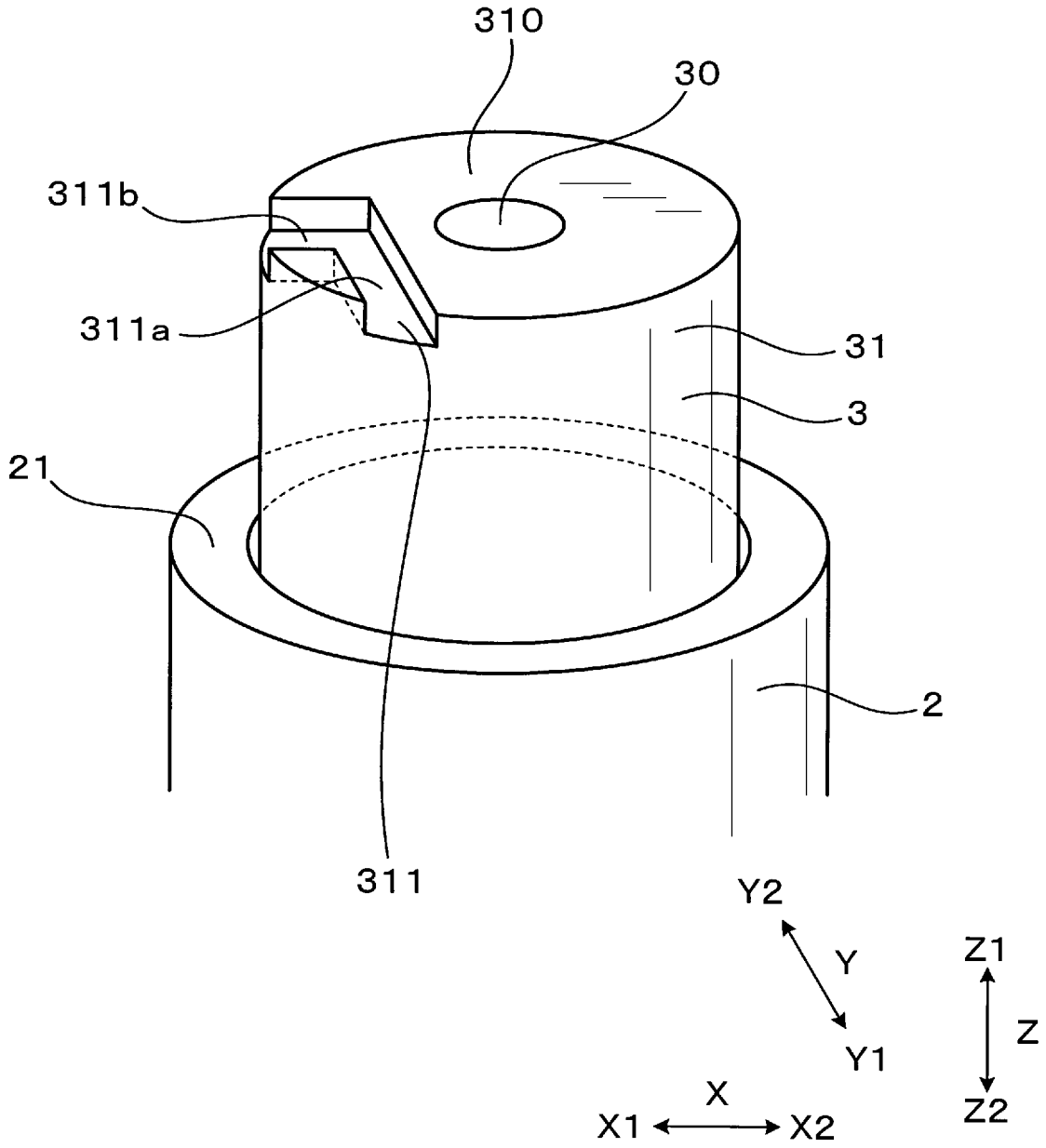
FIG. 6 is a perspective view of a ground electrode and an insulator according to the first embodiment.
Figure 8:
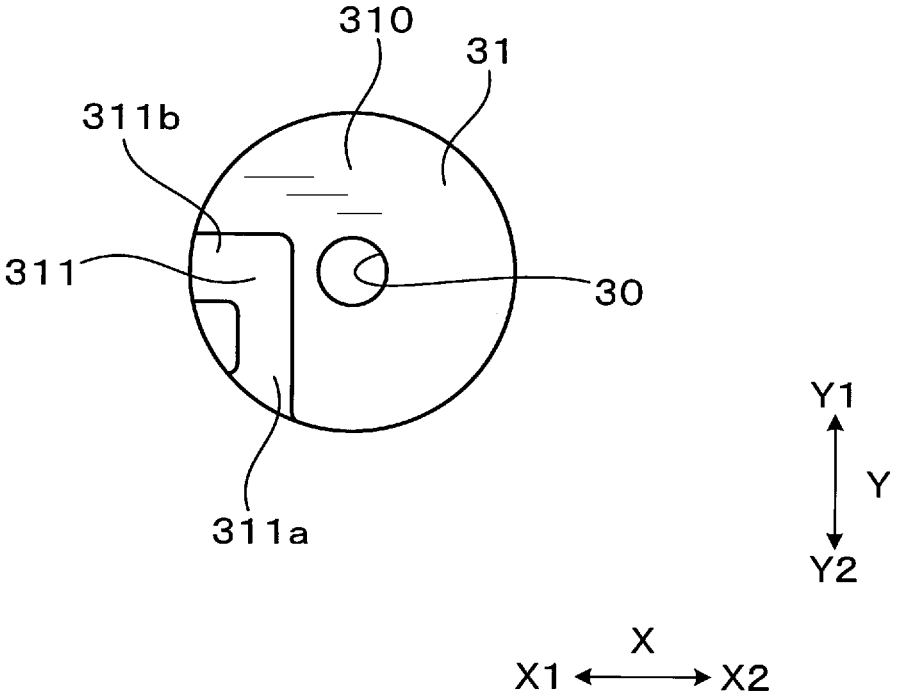
FIG. 8 is a plan view of the insulator according to the first embodiment.

As shown in FIG. 6 and FIG. 8, the insulator 3 has a shaft hole 30 that is formed such as to pass through the center portion of the insulator 3 in the plug axial direction Z. The insulator 3 has an annular cross-sectional shape on a cross-section that is perpendicular to the plug axial direction Z.

As shown in FIG. 5 and FIG. 6, an outer circumferential surface of the insulator 3 in a portion that is positioned on the inner side of the ground electrode 2 opposes the inner circumferential surface of the ground electrode 2 in the plug radial direction with a minute gap (clearance) therebetween. Here, the minute gap may not be formed. That is, the outer circumferential surface of the insulator 3 and the inner circumferential surface of the ground electrode 2 may be in contact with each other.

As shown in FIG. 2 to FIG. 4, the outer circumferential surface of the insulator protruding portion 31 has a circular cylindrical shape that is formed such as to be straight in the plug axial direction Z. Here, the shape of the outer circumferential surface of the insulator protruding portion 31 is not limited thereto.

For example, the outer circumferential surface of the insulator protruding portion 31 may be formed such as to be sloped toward the inner circumferential side in the plug radial direction, toward the Z1 side in the plug axial direction Z. A distal end surface 310 of the insulator protruding portion 31 is formed into a shape of a plane that is perpendicular to the plug axial direction Z. However, the shape of the distal end surface 310 of the insulator protruding portion 31 is not limited thereto.

For example, the distal end surface 310 of the insulator protruding portion 31 may be a sloped surface that is sloped toward the Z2 side, toward the outer circumferential side. Alternatively, the distal end surface 310 of the insulator protruding portion 31 may be a curved surface or the like. A corner portion that connects the outer circumferential surface and the distal end surface 310 of the insulator protruding portion 31 is formed into a round shape (rounded shape). The round shape is omitted in FIG. 2 and FIG. 6.

As shown in FIG. 2 to FIG. 6, and FIG. 8, an insulator groove portion 311 is formed on the distal end surface 310 of the insulator protruding portion 31. The insulator groove portion 311 is formed into a groove shape. The insulator groove portion 311 is formed such that the distal end surface 310 of the insulator protruding portion 31 is recessed toward the Z2 side in the plug axial direction Z.

As shown in FIG. 8, the insulator groove portion 311 has an L-shape when viewed from the plug axial direction Z. The insulator groove portion 311 is formed in an area on one side of the shaft hole 30 in a lateral direction X that is perpendicular to the plug axial direction Z. Both ends of the insulator groove portion 311 in a longitudinal direction thereof (that is, a flow direction of airflow that passes through the communication passage 5) are open.

Hereafter, a side on which the insulator groove portion 311 is formed in relation to the shaft hole 30 in the lateral direction X is referred to as an X1 side. A side opposite the X1 side is an X2 side. In addition, a direction perpendicular to the plug axial direction Z and the lateral direction X is referred to as a vertical direction Y.

As shown in FIG. 6 and FIG. 8, the insulator groove portion 311 has a first insulator groove 311*a* and a second insulator groove 311*b* that are continuously formed. The first insulator groove 311*a* is formed in the vertical direction Y and is open on a Y1 side thereof. The Y1 side is one side in the vertical direction Y. Hereafter, a side opposite the Y1 side in the vertical direction Y is referred to as a Y2 side. The second insulator groove 311*b* is formed in the lateral direction X from an end portion of the first insulator groove 311*a* on the Y2 side. The second insulator groove 311*b* is formed from the Y2-side end portion of the first insulator groove 311*a* toward the X1 side. An end portion of the second insulator groove 311*b* on the X1 side is open.

The center electrode 4 is inserted into and held in a distal end portion of the shaft hole 30 of the insulator 3. As shown in FIG. 1 to FIG. 4, in the center electrode 4, the exposed portion 41 is exposed from the insulator 3. As shown in FIG. 2 and FIG. 3, the exposed portion 41 includes a circular columnar portion 42 and an attached member 43. The circular columnar portion 42 extends from a portion of the center electrode 4 that is arranged inside the shaft hole 30. The attached member 43 is attached to the circular columnar portion 42. Here, the configuration of the center electrode 4 is not limited thereto. The overall center electrode 4 may be configured as an integrated component.

Figure 7:
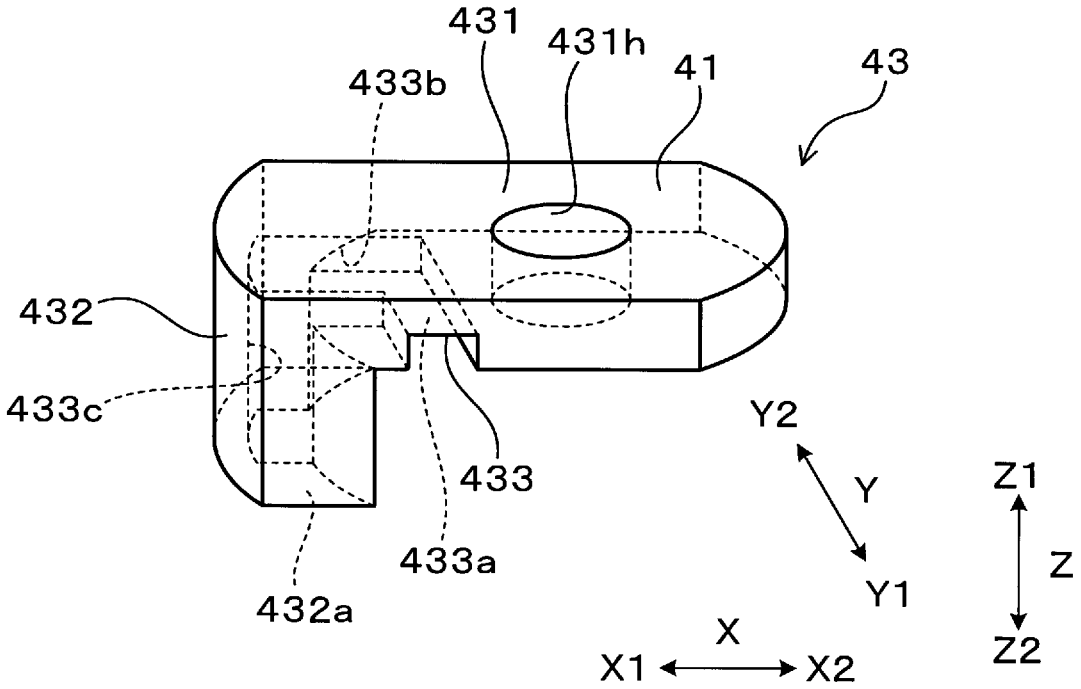
FIG. 7 is a perspective view of an attached member according to the first embodiment.

As shown in FIG. 3, the attached member 43 has an L-shape when viewed from the vertical direction Y. As shown in FIG. 2, FIG. 3, and FIG. 7, the attached member 43 includes a first portion 431 and a second portion 432.

As shown in FIG. 2 and FIG. 3, the first portion 431 covers the insulator protruding portion 31 from the Z1 side in the plug axial direction Z. The first portion 431 has an elongated rectangular shape in the lateral direction X when viewed from the plug axial direction Z. As shown in FIG. 2, FIG. 5, and FIG. 7, both surfaces of the first portion 431 in the lateral direction X are in the shape of a curved surface that protrudes toward the outer side in the lateral direction X. An X1-side end portion of the first portion 431 protrudes further toward the X1 side than the distal end surface 310 of the insulator protruding portion 31. As shown in FIG. 2 and FIG. 3, a surface of the first portion 431 on the Z2 side is in contact with the distal end surface 310 of the insulator protruding portion 31.

As shown in FIG. 2 and FIG. 7, an insertion hole 431*h* is formed in the first portion 431. The circular columnar portion 42 is inserted into the insertion hole 431*h*. As shown in FIG. 2, the attached member 43 is connected to the circular columnar portion 42 at the insertion hole 431*h*.

As shown in FIG. 2 and FIG. 3, the second portion 432 extends from the first portion 431 toward the Z2 side in the plug axial direction Z. In addition, the second portion 432 covers at least a portion of the outer circumferential surface of the insulator protruding portion 31 from the outer circumferential side in the plug radial direction. According to the present embodiment, the second portion 432 extends from the X1-side end portion of the first portion 431 toward the Z2 side and covers the outer circumferential surface of the insulator protruding portion 31 from the X1 side in the lateral direction X. That is, the second portion 432 is arranged only on the X1 side of the insulator protruding portion 31.

As shown in FIG. 2 and FIG. 3, a Z2-side end surface 432*a* of the second portion 432 is positioned further toward the Z2 side than the corner portion between the distal end surface 310 and the outer circumferential surface of the insulator protruding portion 31. As a result, the attached member 43 covers a portion of the corner portion of the insulator protruding portion 31. The Z2-side end surface 432*a* of the second portion 432 is formed into the shape of a plane that is perpendicular to the plug axial direction Z. In addition, the Z2-side end surface 432*a* of the second portion 432 opposes the distal end surface 21 of the ground electrode 2 in the plug axial direction Z.

As shown in FIG. 2, a surface of the second portion 432 on the X2 side is formed into the shape of a curved surface such as to follow the outer circumferential surface of the insulator protruding portion 31. The surface of the second portion 432 on the X2 side is in contact with the outer circumferential surface of the insulator protruding portion 31. Here, a slight gap may be formed between the surface of the second portion 432 on the X2 side and the outer circumferential surface of the insulator protruding portion 31.

As shown in FIG. 2 and FIG. 7, a surface of the second portion 432 on the X1 side is formed into the shape of a curved surface that protrudes toward the X1 side. The surface of the second portion 432 on the X1 side is continuously formed with an end surface of the first portion 431 on the X1 side.

As shown in FIG. 2 to FIG. 4, of spatial distances formed between the ground electrode 2 and the center electrode 4, the spatial distance between the Z2-side end surface 432*a* of the second portion 432 and the distal end surface 21 of the ground electrode 2 in the plug axial direction Z is shortest. In addition, a space between the Z2-side end surface 432*a* of the second portion 432 and the distal end surface 21 of the ground electrode 2 in the plug axial direction Z configures the discharge gap G.

As shown in FIG. 5, in a state in which the spark plug 1 is attached to the internal combustion engine, when viewed from the plug axial direction Z, a virtual straight line L1 that passes through the second portion 432 and the plug center shaft is perpendicular to a flow direction of a main flow F1 of an air-fuel mixture that passes through the distal end portion of the spark plug 1. Here, in the present specification, the main flow F1 of the air-fuel mixture refers to a main flow F1 of the air-fuel mixture that passes through the distal end portion of the spark plug 1 during an engine ignition period. Here, the main flow F1 of the air-fuel mixture may simply be referred to as the main flow F1.

As shown in FIG. 5, the spark plug 1 according to the present embodiment is attached to the internal combustion engine at an attitude at which the flow direction of the main flow F1 is the vertical direction Y. The attachment attitude of the spark plug 1 in the internal combustion engine can be adjusted based on a manner in which the screw of the attachment screw portion 131 of the housing 13 is cut. Here, the adjustment of the attachment attitude of the spark plug 1 in the internal combustion engine is not limited thereto. For example, the attitude of the spark plug 1 may be adjusted by a spacer or a gasket that is sandwiched by the engine head 12 and the housing 13 being arranged on the Z2 side of the attachment screw portion 131, and a stop position of screwing of the spark plug 1 into the engine head 12 being adjusted.

As shown in FIG. 5, in the state in which the spark plug 1 is attached to the internal combustion engine, when viewed from the plug axial direction Z, a virtual straight line L2 that passes through the discharge gap G and the plug center shaft is also perpendicular to the flow direction of the main flow F1 (that is, the vertical direction Y). As a result, portions of the spark plug 1 are not present on both sides of the discharge gap G in the flow direction of the main flow F1. The main flow F1 can easily smoothly flow through the discharge gap G.

As shown in FIG. 2 and FIG. 7, an electrode groove portion 433 is formed on a surface of the attached member 43 that opposes the surface of the insulator protruding portion 31. The electrode groove portion 433 is formed into a groove shape. The electrode groove portion 433 is formed in an area on the X1 side of the shaft hole 30 in the lateral direction X. Both ends of the electrode groove portion 433 in a longitudinal direction thereof (that is, the flow direction of the airflow that passes through the communication passage 5) are open.

As shown in FIG. 7, the electrode groove portion 433 includes a first electrode groove 433*a*, a second electrode groove 433*b*, and a third electrode groove 433*c* that are continuously formed. The first electrode groove 433*a* and the second electrode groove 433*b* are formed into groove shapes in which the Z2-side end surface of the first portion 431 of the attached member 43 is recessed toward the Z1 side. The third electrode groove 433*c* is formed into a groove shape in which the surface of the second portion 432 on the X2 side is recessed toward the X1 side.

The first electrode groove 433*a* is formed in the vertical direction Y and is open on the Y1 side. As shown in FIG. 2, the first electrode groove 433*a* is formed in a position that overlaps the first insulator groove 311*a* in the plug axial direction Z. As shown in FIG. 2 and FIG. 5, the opening portion of the first electrode groove 433*a* on the Y1 side is formed in a position that is offset further toward the Y2 side in the vertical direction Y than the opening portion of the first insulator groove 311*a* on the Y1 side. However, the configuration of the first electrode groove 433*a* is not limited thereto.

As shown in FIG. 7, the second electrode groove 433*b* is formed in the lateral direction X from the Y2-side end portion of the first electrode groove 433*a*. The second electrode groove 433*b* is formed from the Y2-side end portion of the first electrode groove 433*a* toward the X1 side. As shown in FIG. 2 and FIG. 5, the second electrode groove 433*b* is formed in a position that overlaps the second insulator groove 311*b* in the plug axial direction Z. As shown in FIG. 3 and FIG. 5, the second electrode groove 433*b* is formed such that an X1-side end portion protrudes further toward the X1 side than the second insulator groove 311*b*.

As shown in FIG. 7, the third electrode groove 433*c* is formed in the plug axial direction Z from the X1-side end portion of the second electrode groove 433*b*. The third electrode groove 311*c* extends from the X1-side end portion of the second electrode groove 433*b* toward the Z2 side. In the third electrode groove 433*c*, a Z2-side end portion is open on the Z2 side. As shown in FIG. 2 to FIG. 4, the third electrode groove 433*c* is open toward the discharge gap G. As shown in FIG. 2 and FIG. 3, the X2 side of the third electrode groove 433*c* is closed by the outer circumferential surface of the insulator protruding portion 31.

As shown in FIG. 2 to FIG. 5, an area that is surrounded by the first electrode groove 433*a*, the second electrode groove 433*b*, the first insulator groove 311*a*, and the second insulator groove 311*b*, and an area surrounded by the third electrode groove 433*c* and the outer circumferential surface of the insulator protruding portion 31 form the above-described communication passage 5.

As shown in FIG. 2 to FIG. 5, the communication passage 5 includes a first path 51, a second path 52, and a third path 53. The first path 51 is surrounded by the first electrode groove 433*a* and the first insulator groove 311*a*. The second path 52 is surrounded by the second electrode groove 433*b* and the second insulator groove 311*b*. The third path 53 is surrounded by the third electrode groove 433*c* and the outer circumferential surface of the insulator protruding portion 31.

As shown in FIG. 2 and FIG. 5, the first path 51 is formed in the vertical direction Y. The flow inlet 501 that is open on the Y1 side is formed on the Y1 side of the first path 51. The overall circumference of the flow inlet 501 is surrounded by both the first electrode groove 433*a* and the first insulator groove 311*a*. Here, as shown in FIG. 2 and FIG. 5, when the opening portion of the first electrode groove 433*a* on the Y1 side and the opening portion of the first insulator groove 311*a* on the Y1 side are offset, a first open portion of the communication passage 5 on the path from the flow outlet 502 toward the flow inlet 501 is referred to as the flow inlet 501.

That is, according to the present embodiment, the flow inlet 501 is formed in the same position as the opening position of the first electrode groove 433*a* in the vertical direction Y. In the state in which the spark plug 1 is attached to the internal combustion engine, the flow inlet 501 is open toward an intake valve side of the internal combustion engine. As a result, as shown in FIG. 5, the flow inlet 501 is open on an upstream side of the main flow F1, that is, on the Y1 side in the state in which the spark plug 1 is attached to the internal combustion engine.

As shown in FIG. 2 and FIG. 5, the second path 52 is formed in the lateral direction X. An end portion of the second path 52 on the X2 side communicates with the first path 51. An end portion of the second path 52 on the X1 side communicates with the third path 53.

As shown in FIG. 2 and FIG. 3, the third path 53 is formed in the plug axial direction Z from an X1-side end portion of the second path 52. The third path 53 is formed from the X1-side end portion of the second path 52 toward the Z2 side. As shown in FIG. 2 to FIG. 4, the flow outlet 502 is formed on the Z2 side of the third path 53 in the plug axial direction Z. The flow outlet 502 is open in a direction intersecting with the plug circumferential direction.

According to the present embodiment, the flow outlet 502 is open toward the Z2 side in the plug axial direction Z. In addition, the flow outlet 502 is open toward the distal end surface 21 of the ground electrode 2. The overall circumference of the flow outlet 502 is surrounded by the third electrode groove 433*c* and the surface of the insulator protruding portion 31. The flow outlet 502 is configured by only the electrode groove portion 433, of the electrode groove portion 433 and the insulator groove portion 311. The flow outlet 502 is formed in the same position as the opening portion of the third electrode groove 433*c* in the plug axial direction Z.

As shown in FIG. 5, in the state in which the spark plug 1 is attached to the internal combustion engine, when viewed from the plug axial direction Z, a virtual straight line L3 that passes through the flow outlet 502 and the plug center shaft is perpendicular to the flow direction of the main flow F1 (that is, the vertical direction Y). In addition, in the state in which the spark plug 1 is attached to the internal combustion engine, when viewed from the plug axial direction Z, the virtual straight line L3 is perpendicular to an straight line (array direction) connecting the intake valve and an exhaust valve of the internal combustion engine. In other words, in the state in which the spark plug 1 is attached to the internal combustion engine, when viewed from the plug axial direction Z, a tangential direction of a portion of the insulator 3 in which the flow outlet 502 is formed is parallel to the straight line (array direction) connecting the intake valve and the exhaust valve.

Figure 9:
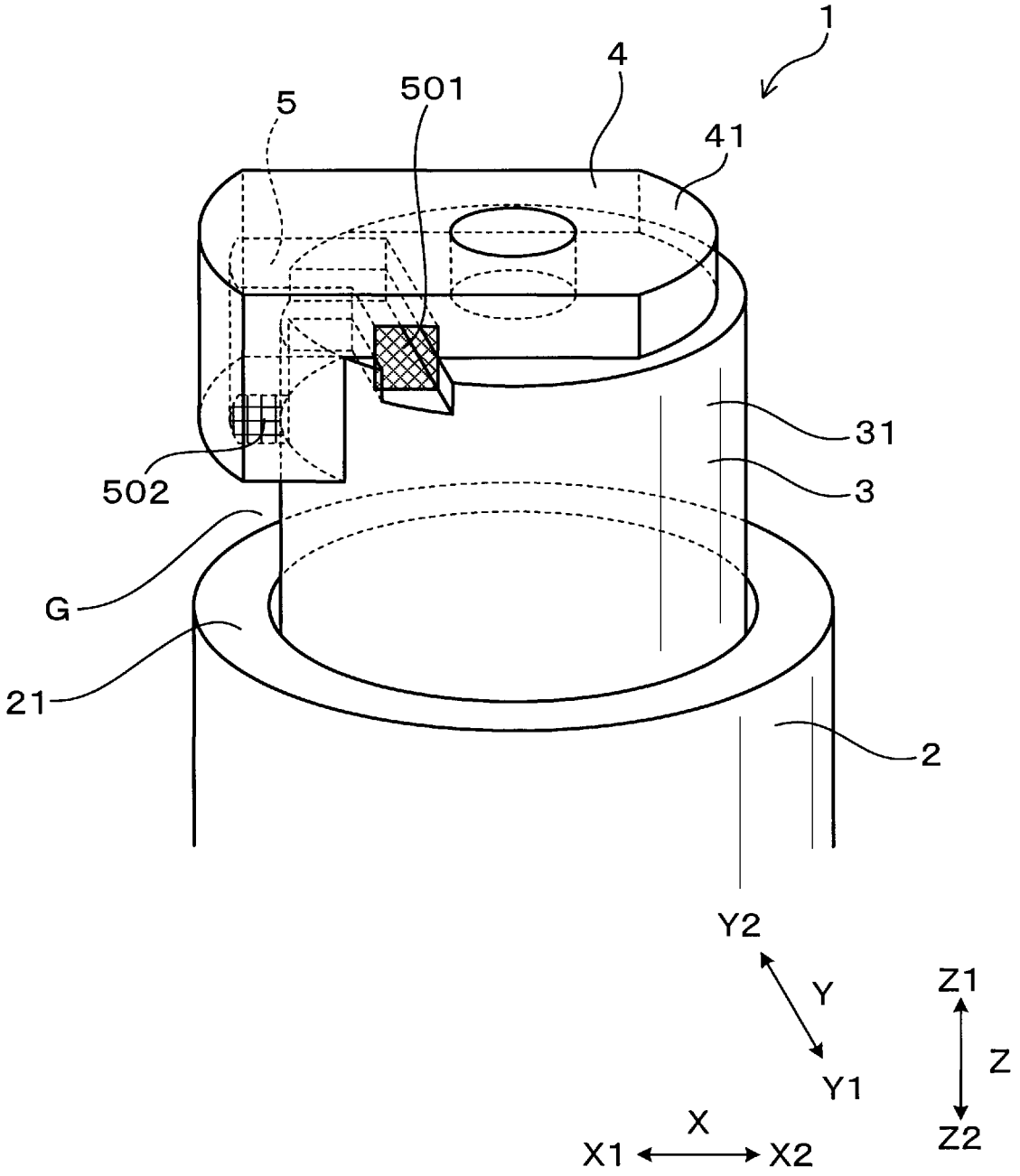
FIG. 9 is a perspective view of the distal end portion of the spark plug according to the first embodiment, and a diagram for explaining a flow inlet and a flow outlet.

As shown in FIG. 9, an area of the flow outlet 502 is smaller than an area of the flow inlet 501. As a result, a flow rate of airflow that passes through the communication passage 5 and flows out from the flow outlet 502 can be made faster than a flow rate of airflow that passes through the flow inlet 501. Here, the area of the flow outlet 502 is a cross-sectional area of the flow outlet 502, the cross-section being perpendicular to a flowrate direction of the airflow that passes through the flow outlet 502 (that is, the plug axial direction Z).

In addition, the area of the flow inlet 501 is a cross-sectional area of the flow inlet 501, the cross-section being perpendicular to a flowrate direction of the airflow that passes through the flow outlet 502 (that is, the vertical direction Y). In FIG. 9, the flow inlet 501 and the flow outlet 502 are hatched. Furthermore, the airflow that passes through the communication passage 5 may be referred to, hereafter, as a specific airflow F2.

Next, an ignition apparatus 10 that is configured by the spark plug 1 according to the present embodiment being attached to the internal combustion engine will be described.

As shown in FIG. 1, the spark plug 1 is screwed into the female screw hole 122, by the attachment screw portion 131. The female screw hole 122 is provided in the plug hole 121 of the engine head 12. As a result, the spark plug 1 is fastened and fixed to the engine head 12. In addition, the distal end portion of the spark plug 1 is arranged in the combustion chamber 11. At this time, as shown in FIG. 5, the spark plug 1 is attached at an attitude at which the main flow F1 inside the combustion chamber 11 flows from the Y1 side toward the Y2 side in the vertical direction Y, in relation to the distal end portion of the spark plug 1.

Of the airflow that flows through the distal end portion of the spark plug 1, the specific airflow (refer to reference number F2 in FIG. 10 to FIG. 12) that flows through the communication passage 5 is introduced from the flow inlet 501 into the communication passage 5 in the vertical direction Y. The specific flow F2 is then discharged from the flow outlet 502 toward the Z2 side in the plug axial direction Z.

Next, an example of a state in which a discharge spark generated in the spark plug 1 is stretched by the airflow of the air-fuel mixture in the combustion chamber 11 will be described with reference to FIG. 10 to FIG. 15.

Figure 10:
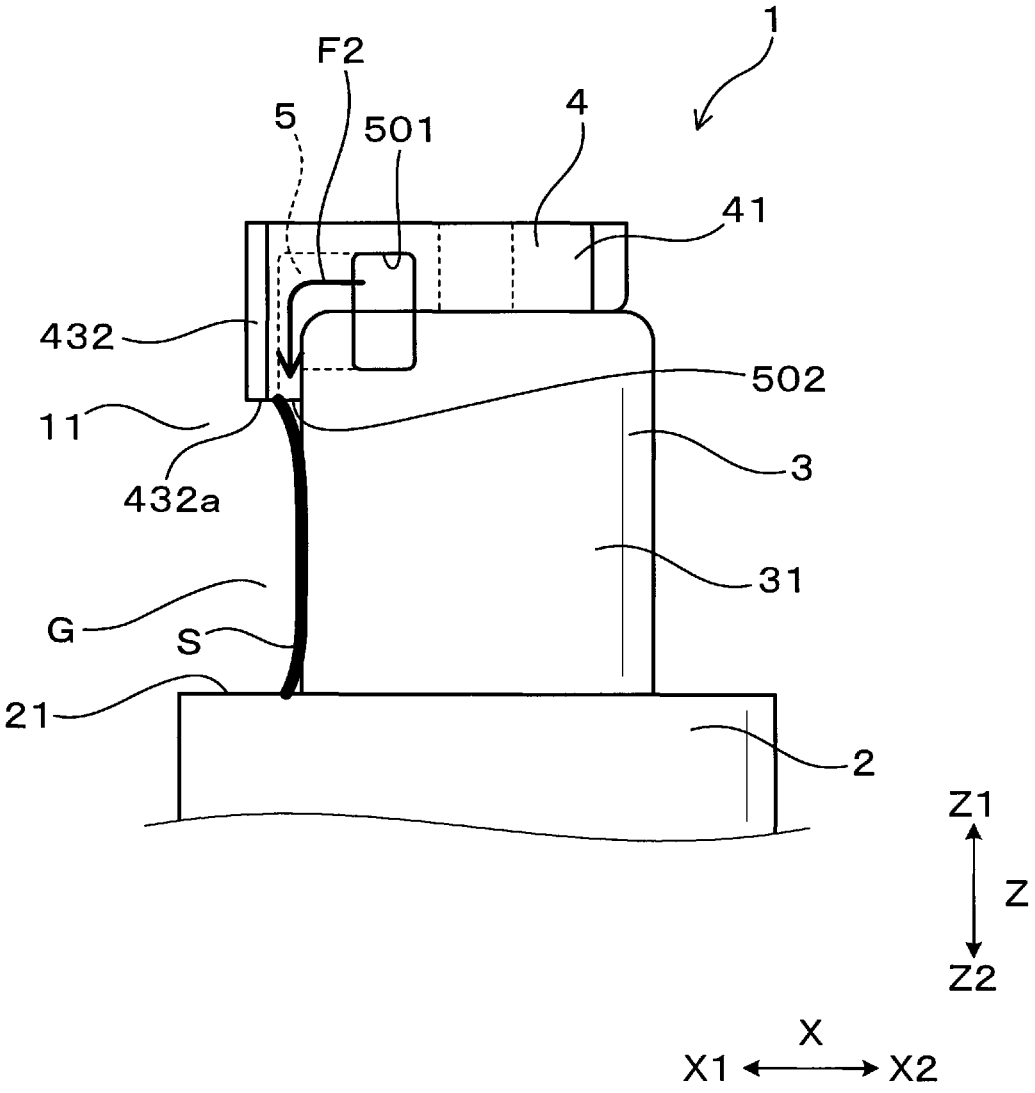
FIG. 10 is an enlarged front view of the distal end portion of the spark plug according to the first embodiment, and an explanatory diagram of an initial discharge spark.
Figure 13:
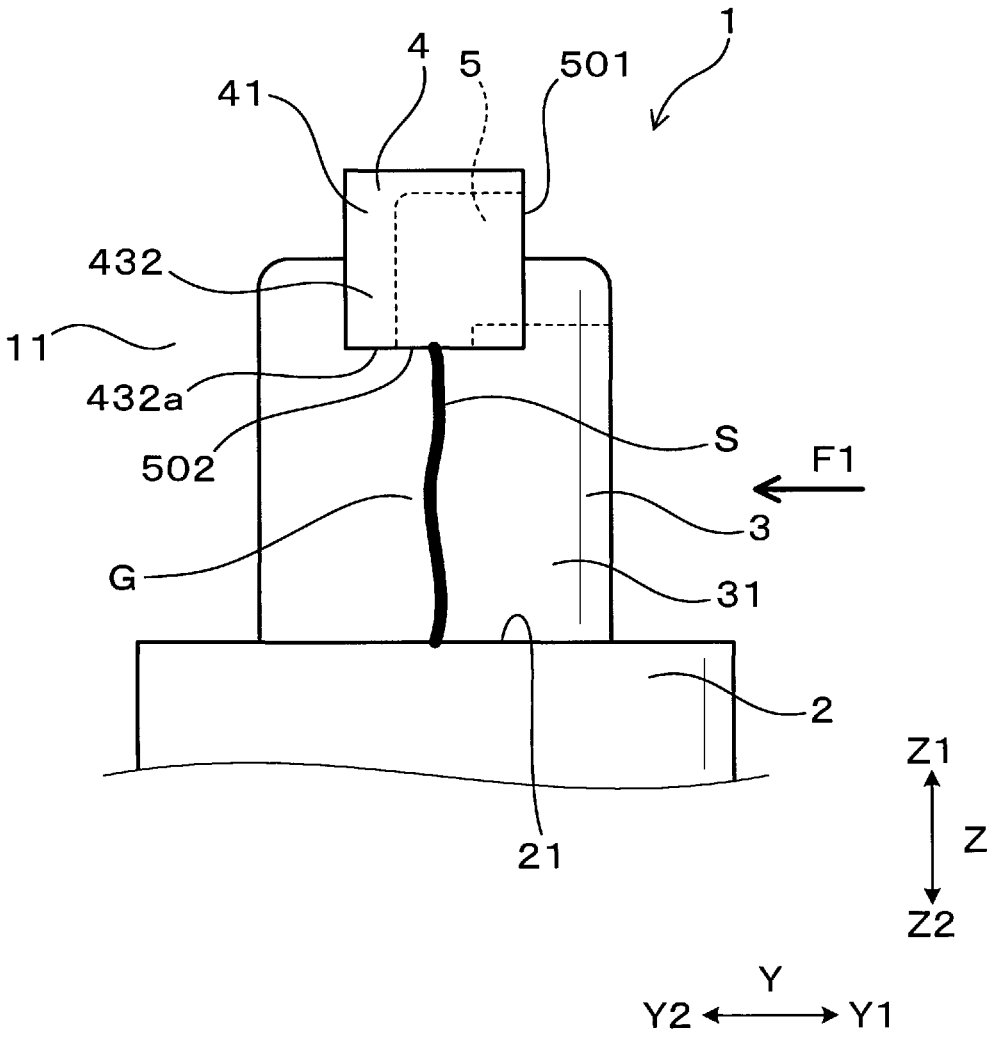
FIG. 13 is an enlarged side view of the distal end portion of the spark plug according to the first embodiment, and an explanatory diagram of the initial discharge spark.
Figure 14:
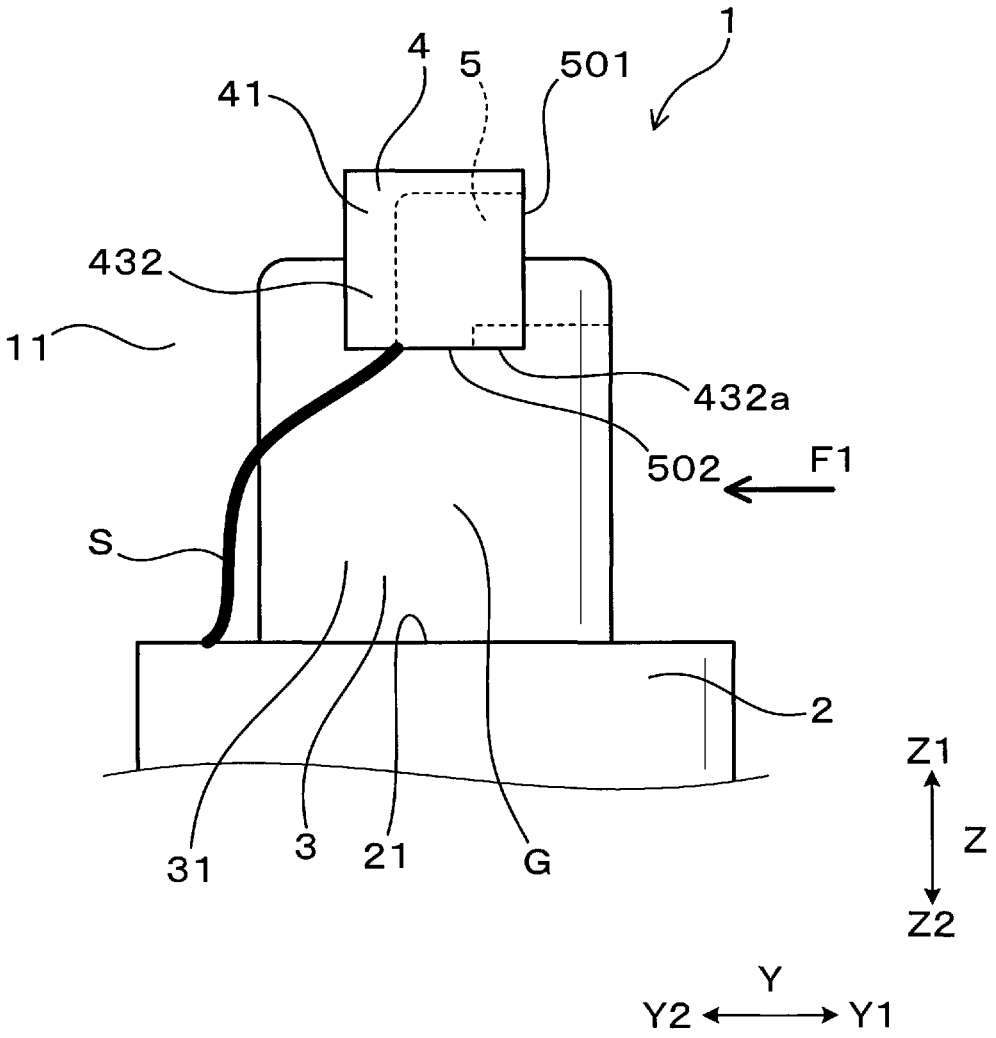
FIG. 14 is an enlarged side view of the distal end portion of the spark plug according to the first embodiment, and an explanatory diagram of a state in which the initial discharge spark is pushed by the specific airflow and starts to be separated from the surface of the insulator protruding portion.
Figure 15:
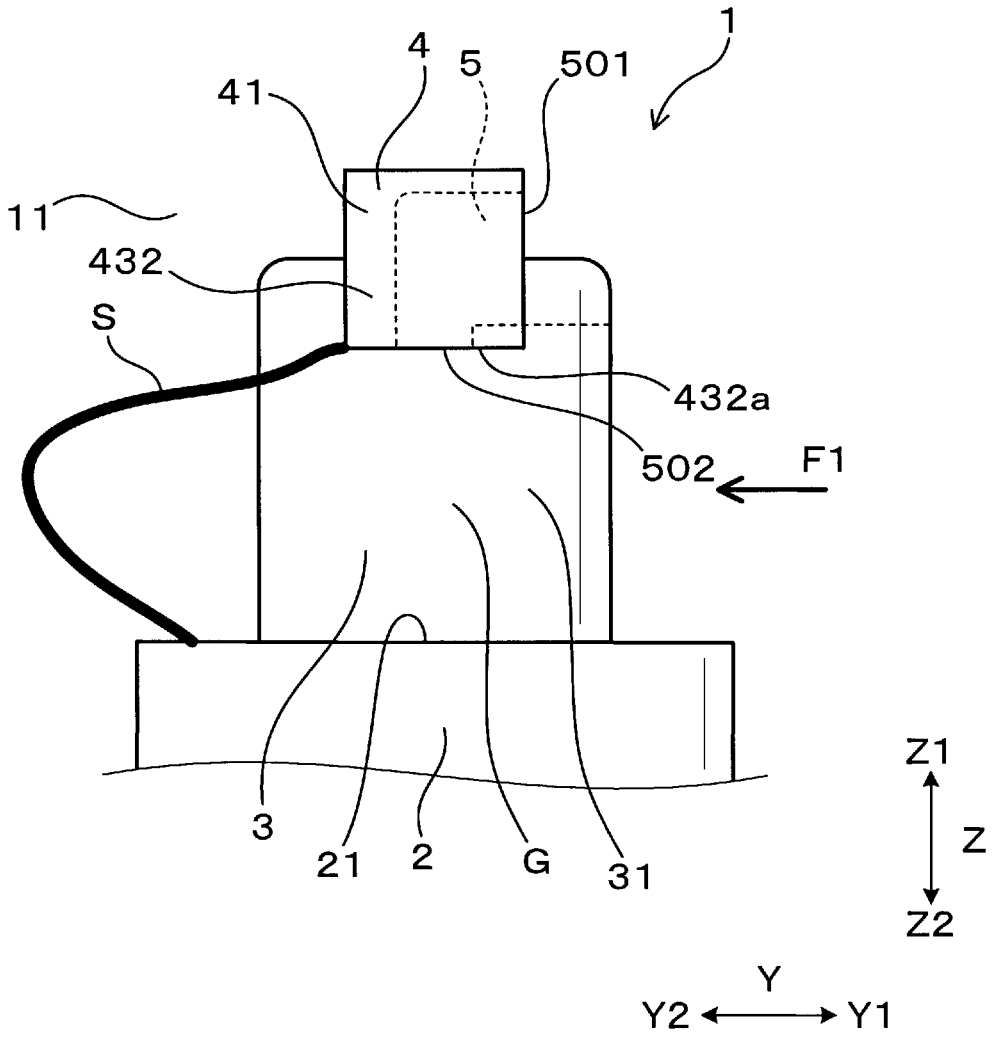
FIG. 15 is an enlarged side view of the distal end portion of the spark plug according to the first embodiment, and an explanatory diagram of a state in which the overall initial discharge spark is separated from the surface of the insulator protruding portion.

As shown in FIG. 10 and FIG. 13, a discharge of the spark plug 1 is generated in the discharge gap G, with the Z2-side end surface 432*a* of the second portion 432 and the distal end surface 21 of the ground electrode 2 as points of origin. Here, as shown in FIG. 10, a section between both points of origin of a discharge spark S that is generated as a result of the discharge is formed such as to creep over the outer circumferential surface of the insulator protruding portion 31.

Figure 11:
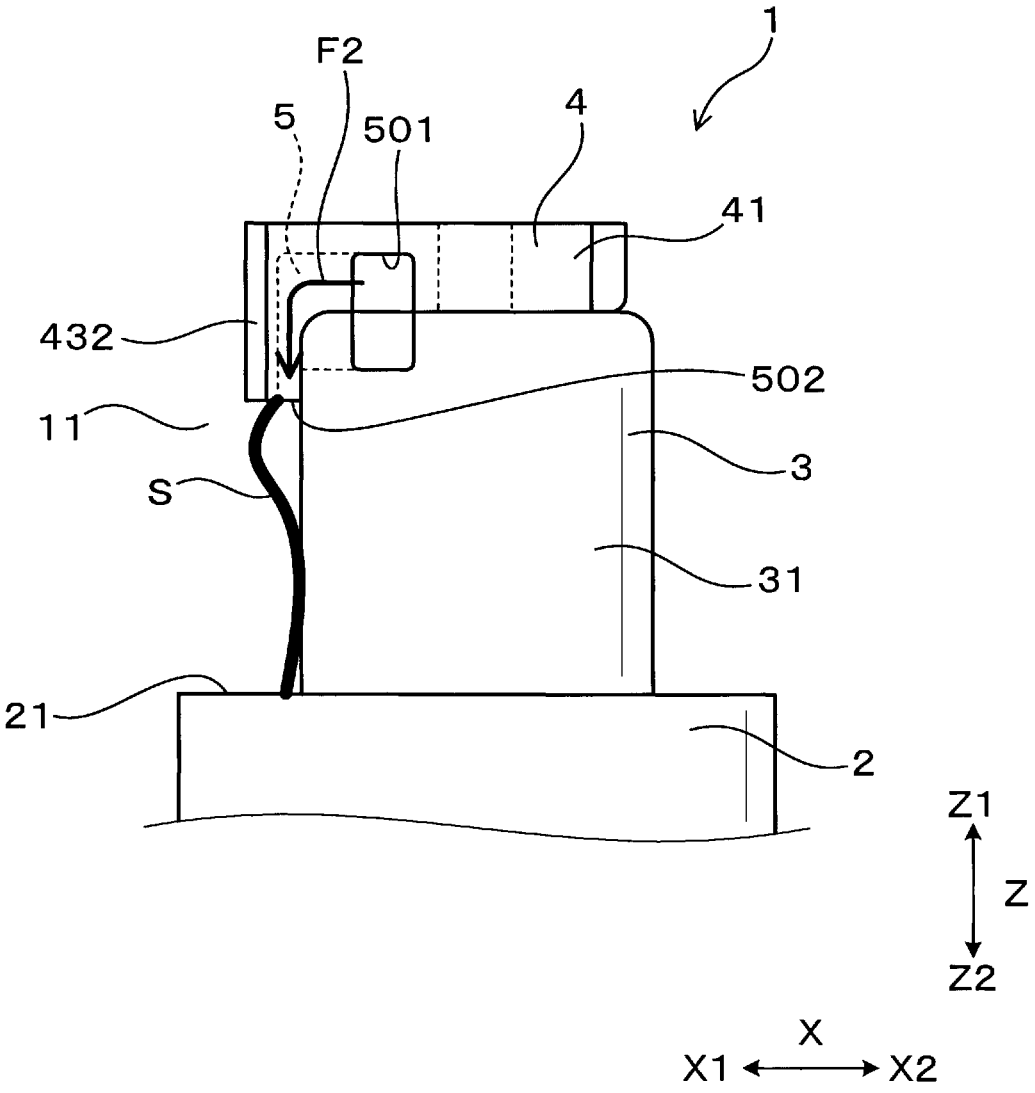
FIG. 11 is an enlarged front view of the distal end portion of the spark plug according to the first embodiment, and an explanatory diagram of a state in which the initial discharge spark is pushed by a specific airflow and starts to be separated from a surface of an insulator protruding portion.
Figure 12:
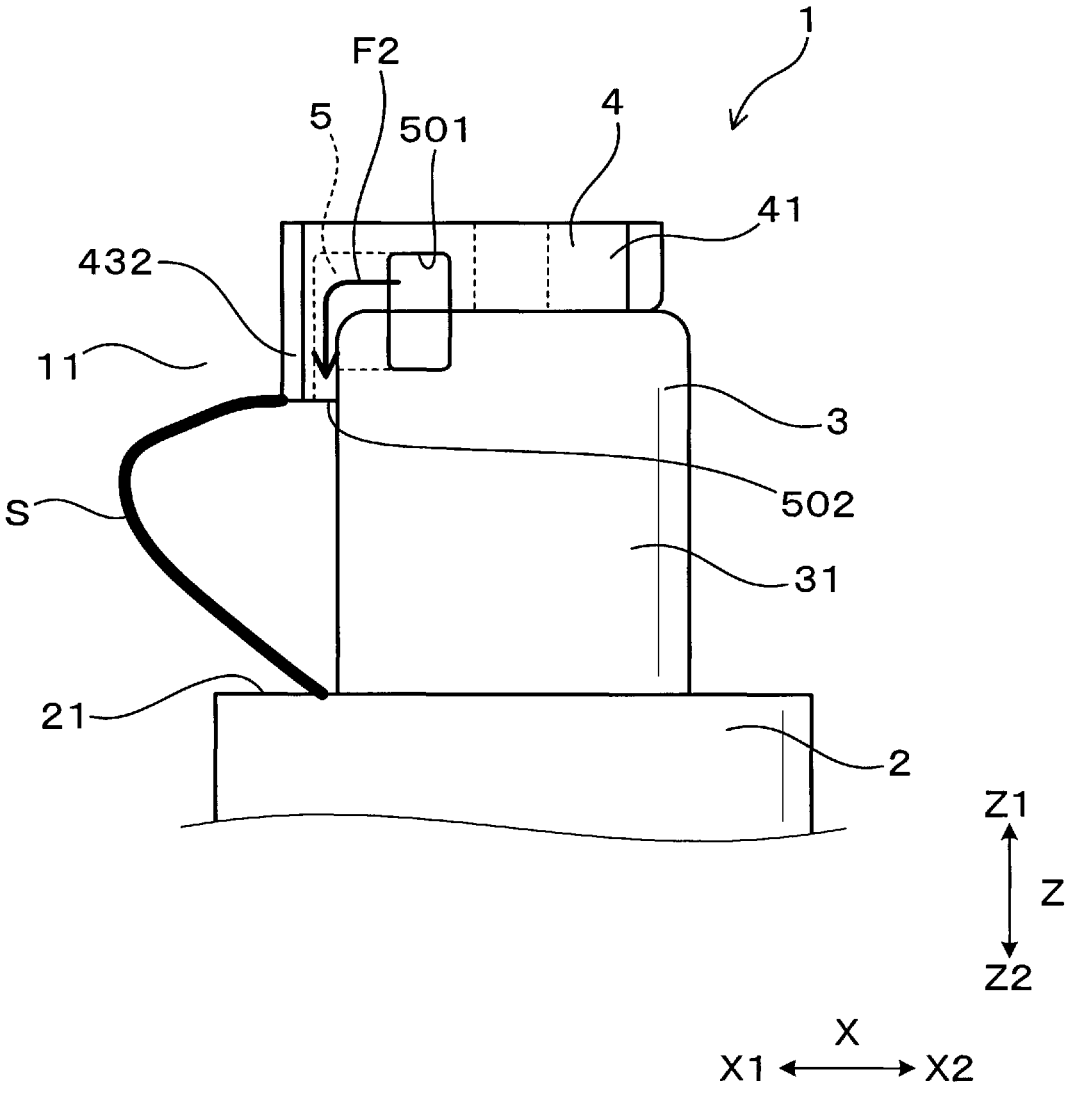
FIG. 12 is an enlarged front view of the distal end portion of the spark plug according to the first embodiment, and an explanatory diagram of a state in which the overall initial discharge spark is separated from the surface of the insulator protruding portion.

Then, as shown in FIG. 11, a portion of the discharge spark S near the flow outlet 502 is pushed by the specific airflow F2 that is discharged from the flow outlet 502 of the communication passage 5 and is separated from the outer circumferential surface of the insulator protruding portion 31. Next, as shown in FIG. 12, the overall portion between both points of origin of the discharge spark S is separated from the outer circumferential surface of the insulator protruding portion 31 such as to follow the portion near the flow outlet 502.

In addition, simultaneously with the separation of the discharge spark S from the outer circumferential surface of the insulator protruding portion 31, as described above, as shown in FIG. 13 to FIG. 15, the overall discharge spark S is pushed by the main airflow F1 that passes through the discharge gap G in the vertical direction Y and is gradually stretched toward a downstream side of the main flow F1. The discharge spark S is stretched in this manner.

Next, working effects according to the present embodiment will be described.

In the spark plug 1 for an internal combustion engine according to the present embodiment, at least one of the exposed portion 41 and the insulator protruding portion 31 includes the flow inlet 501, the flow outlet 502, and the communication passage 5. The flow inlet 501 is open on the outer circumferential surface of the at least one of the exposed portion 41 and the insulator protruding portion 31. The flow outlet 502 is open toward the discharge gap G. The communication passage 5 communicates between the flow inlet 501 and the flow outlet 502. Therefore, the airflow inside the combustion chamber 11 flows into the communication passage 5 from the flow inlet 501, and is discharged from the flow outlet 502 toward the discharge gap G.

As a result, the discharge spark S that is generated in the discharge gap G is pushed by the airflow that flows out from the flow outlet 502 and is separated from the outer circumferential surface of the insulator protruding portion 31 of the insulator 3 at an early stage. Consequently, cooling loss that occurs as a result of heat of a flame that is generated by spark discharge of the spark plug 1 being drawn to the insulator 3 can be reduced. As a result, ignition reliability of the spark plug 1 can be improved.

In addition, in the state in which the spark plug 1 is attached to the internal combustion engine, when viewed from the plug axial direction Z, the virtual straight line L3 that passes through the flow outlet 502 and the plug center shaft is perpendicular to a straight lime (array direction) connecting the intake valve and the exhaust valve of the internal combustion engine. In accompaniment, in the state in which the spark plug 1 is attached to the internal combustion engine, when viewed from the plug axial direction Z, the virtual straight line L3 that passes through the flow outlet 502 and the plug center shaft is perpendicular to the flow direction of the main flow F1 of the air-fuel mixture that passes through the distal end portion of the spark plug 1.

Therefore, the specific airflow F2 that passes through the communication passage 5 and is discharged from the flow outlet 502 is discharged toward the main flow F1 that flows through the distal end portion of the spark plug 1 in the vertical direction Y, without being inhibited by the spark plug 1.

As a result, in an area in which the main flow F1 that passes through the distal end portion of the spark plug 1 without being inhibited by the spark plug 1 flows, the discharge spark S can be pulled away from the outer circumferential surface of the insulator protruding portion 31. The discharge spark S can be more easily stretched toward the downstream side of the main flow F1. Consequently, a contact area between the discharge spark S and the air-fuel mixture is easily ensured. Ignition reliability of the spark plug 1 can be further improved.

In addition, in the state in which the spark plug 1 is attached to the internal combustion engine, the flow inlet 501 is open toward the intake valve side of the internal combustion engine. In accompaniment, in the state in which the spark plug 1 is attached to the internal combustion engine, the flow inlet 501 is open toward the upstream side of the main flow F1 of the air-fuel mixture that flows through the distal end portion of the spark plug 1.

Therefore, the airflow easily flows into the communication passage 5. The flowrate of the specific airflow F2 that is discharged from the flow outlet 502 of the communication passage 5 is easily improved. Consequently, the discharge spark S that is generated in the discharge gap G can be separated (pulled away) from the outer circumferential surface of the insulator 31 at an earlier stage.

In addition, the area of the flow outlet 502 is smaller than the area of the flow inlet 501. As a result of this configuration as well, the flow rate of the specific airflow F2 that is discharged from the flow outlet 502 of the communication passage 5 can be improved. Furthermore, according to the present embodiment, the flow inlet 501 is configured by both the electrode groove portion 433 and the insulator groove portion 311. The flow outlet 502 is configured by only the electrode groove portion 433, of the electrode groove portion 433 and the insulator groove portion 311. Therefore, the area of the flow inlet 501 is more easily made greater than the area of the flow outlet 502.

In addition, the exposed portion 41 includes the first portion 431 and the second portion 432. The first portion 431 covers the insulator protruding portion 31 from the Z1 side of the plug axial direction Z. The second portion 432 extends from the first portion 431 toward the Z2 side in the plug axial direction Z. The second portion 432 covers at least a portion of the outer circumferential surface of the insulator protruding portion 31 from the outer circumferential side in the plug radial direction. That is, a corner portion in the distal end portion of the insulator protruding portion 31 is covered by the first portion 431 and the second portion 432 of the exposed portion 41.

Therefore, the discharge is formed between the second portion 432 of the center electrode 4 and the ground electrode 2, without being generated above the corner portion of the distal end portion of the insulator protruding portion 31. As a result, the discharge is easily separated from the surface of the insulator protruding portion 31 and stretched toward the downstream side, by the main flow F1 of the air-fuel mixture inside the combustion chamber 11, the specific airflow F2 that passes through the communication passage 5 and is discharged from the flow outlet 502, or an electrical repulsion effect. Consequently, ignition reliability of the spark plug 1 can be improved.

In addition, the second portion 432 is formed only in a portion in the plug circumferential direction. Therefore, a discharge position in the plug circumferential direction can be easily identified. That is, the discharge can be easily generated between the second portion 432 and the distal end surface 21 of the ground electrode 2 in the plug circumferential direction. Therefore, discharge being generated in an unexpected location in the plug circumferential direction can be easily prevented. As a result, the specific airflow F2 can be reliably directed to the discharge spark S that is generated in the discharge gap G.

In addition, the communication passage 5 is configured by the groove that is formed in at least one of the exposed portion 41 and the insulator protruding portion 31. Therefore, the communication passage 5 can be easily formed.

As described above, according to the present embodiment, a spark plug for an internal combustion engine that is capable of improving ignition reliability can be provided.

Second Embodiment

Figure 16:
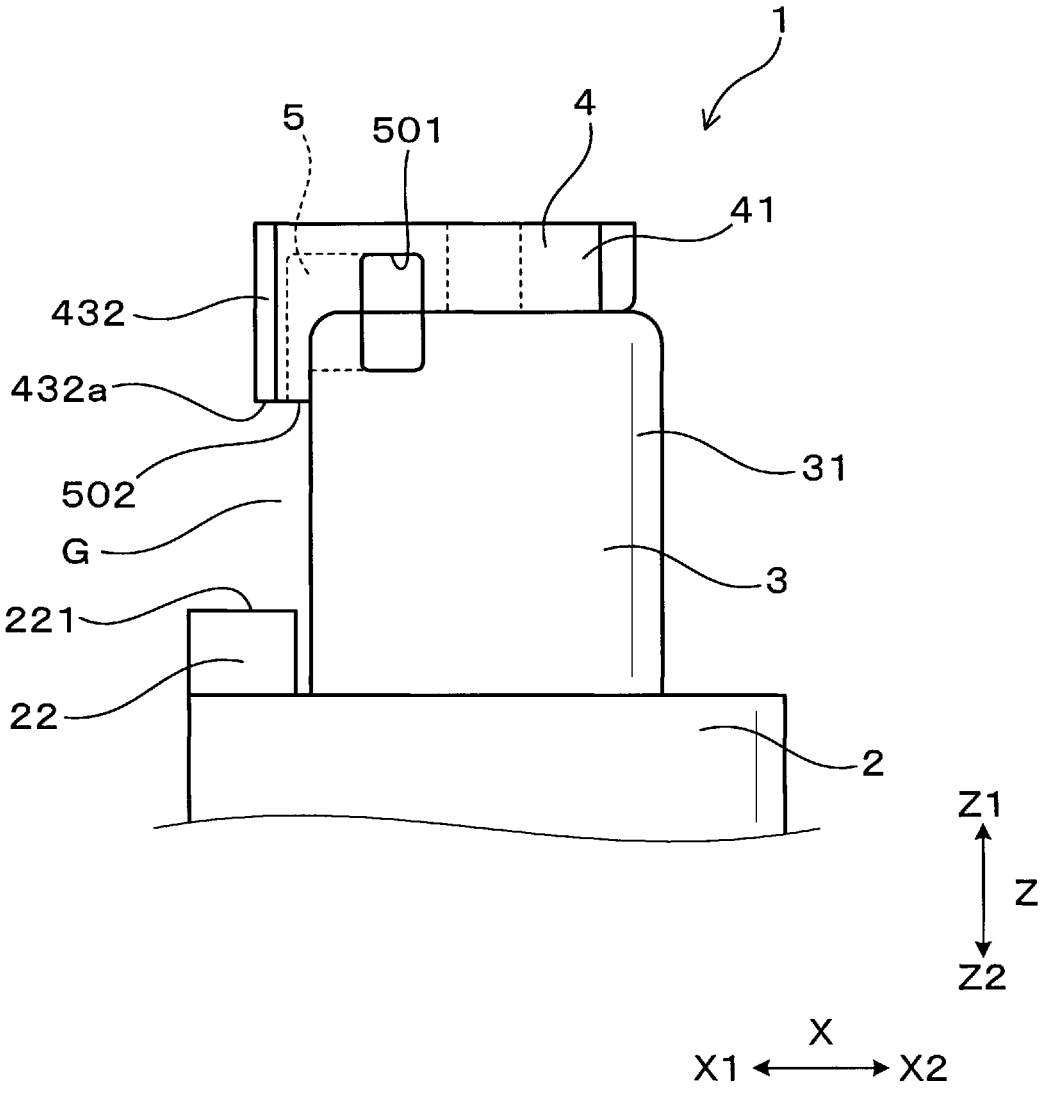
FIG. 16 is a front view of the distal end portion of the spark plug according to a second embodiment.
Figure 17:
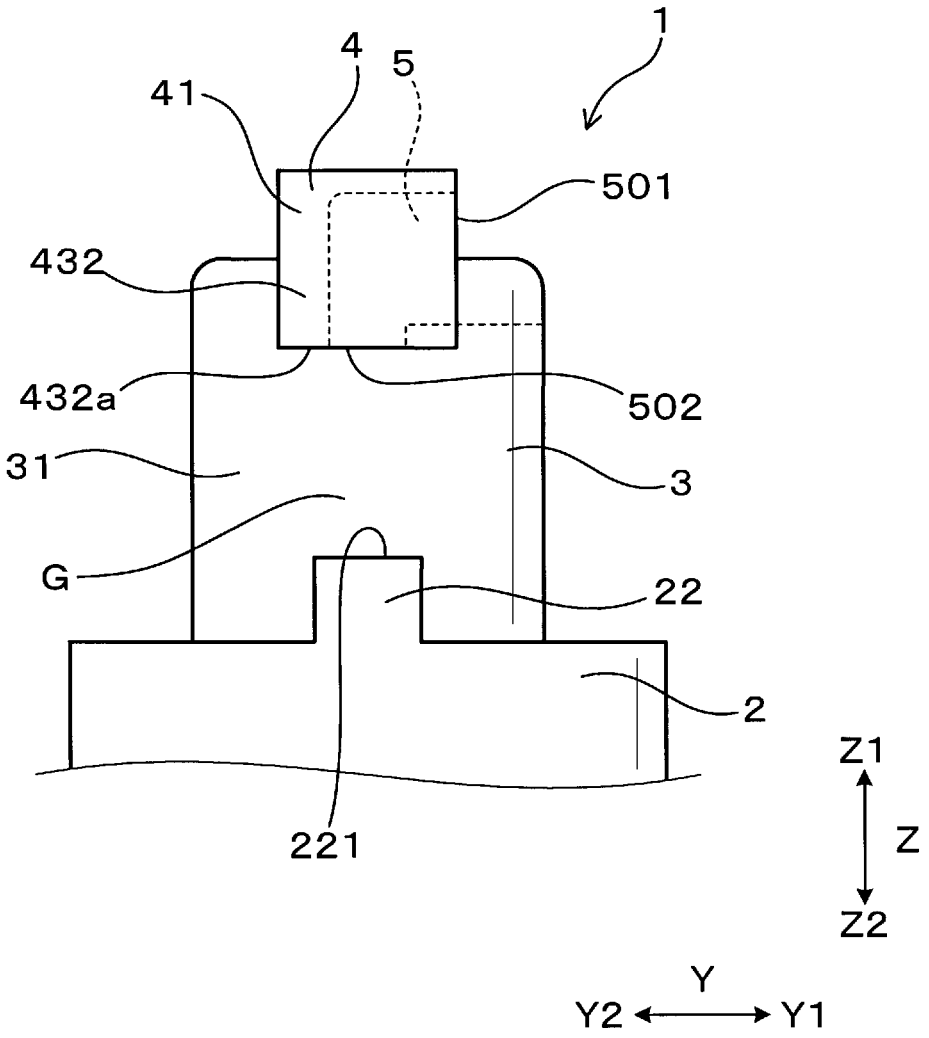
FIG. 17 is a side view of the distal end portion of the spark plug according to the second embodiment.

According to a second embodiment, as shown in FIG. 16 and FIG. 17, the shape of the ground electrode 2 is changed from that according to the first embodiment.

According to the present embodiment, the ground electrode 2 includes a ground electrode protruding portion 22. The ground electrode protruding portion 22 protrudes toward the Z1 side in the plug axial direction Z and forms the discharge gap G with the exposed portion 41. The ground electrode protruding portion 22 is in the shape of a rectangular parallelepiped. In the plug circumferential direction, the ground electrode protruding portion 22 is formed in the same position as the Z2-side end surface 432*a* of the second portion 432 of the center electrode 4. In addition, a distal end surface 221 of the ground electrode protruding portion 22 is formed such as to overlap the Z2-side end surface 432*a* of the second portion 432 in the plug axial direction Z.

Other configurations are similar to those according to the first embodiment.

Here, of the reference numbers used according to the second and subsequent embodiments, reference numbers that are the same as those used according to a previous embodiment indicate constituent elements and the like that are similar to those according to the previous embodiment, unless otherwise noted.

According to the present embodiment, the discharge position in the plug circumferential direction can be easily identified. That is, the discharge can be reliably generated between the second position 432 and the ground electrode protruding portion 22 in the plug circumferential direction. Therefore, discharge being generated in an unexpected location in the plug circumferential direction can be prevented. As a result, the specific airflow F2 can be reliably directed to the discharge spark that is generated in the discharge gap G.

Other working effects are similar to those according to the first embodiment.

Third Embodiment

Figure 18:
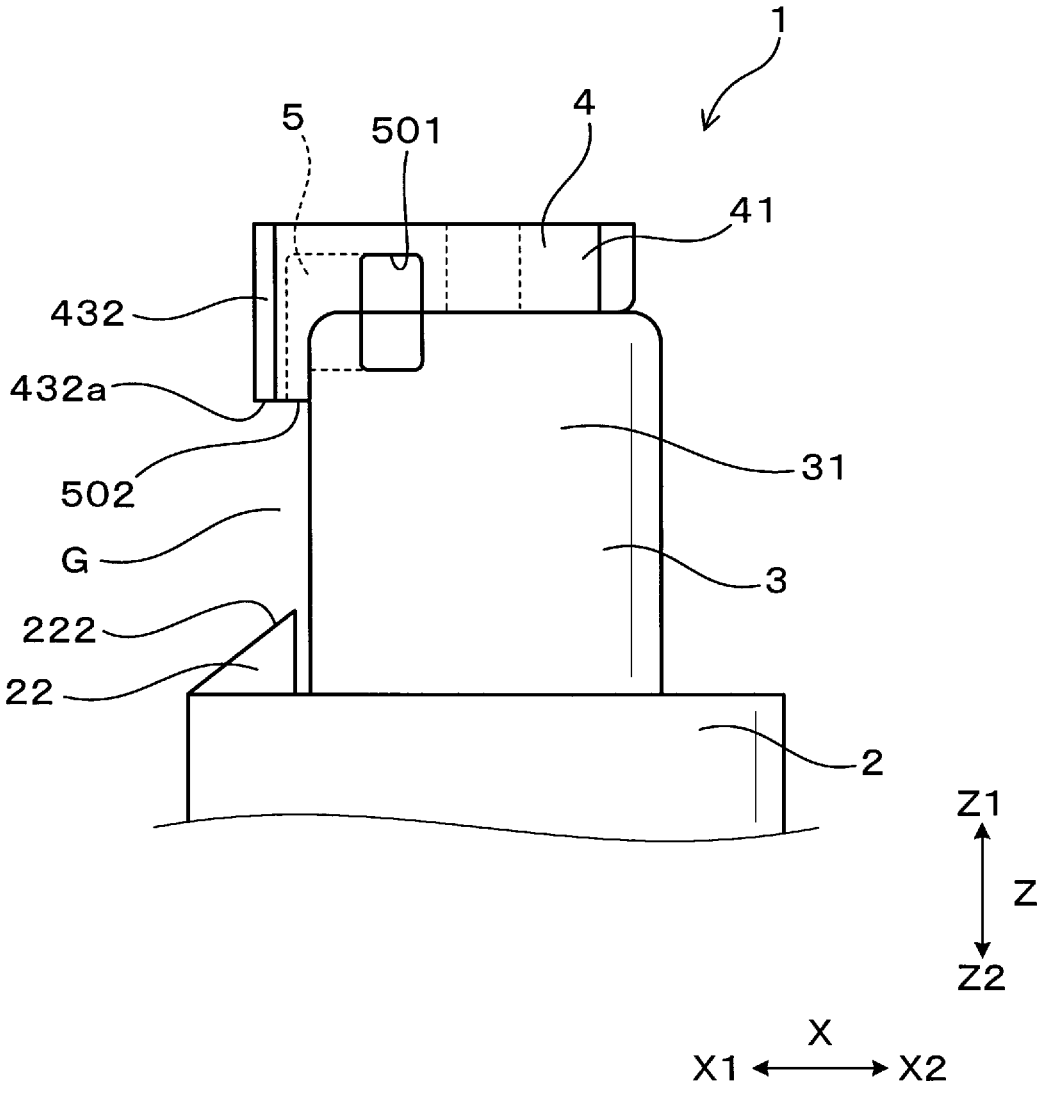
FIG. 18 is a front view of the distal end portion of the spark plug according to a third embodiment.

According to a third embodiment, as shown in FIG. 18, the shape of the ground electrode protruding portion 22 is changed from that according to the second embodiment.

According to the present embodiment, the ground electrode protruding portion 22 is configured such that a thickness thereof in the plug radial direction decreases toward the Z1 side in the plug axial direction Z. Specifically, a surface 222 of the ground electrode protruding portion 22 on the X1 side is sloped toward the X2 side, toward the Z1 side in the plug axial direction Z. In addition, a distal end portion of the ground electrode protruding portion 22 is formed into the shape of a sharp corner.

Other configurations are similar to those according to the second embodiment.

According to the present embodiment, field intensity in the periphery of the distal end portion of the ground electrode protruding portion 22 can be increased. Therefore, the discharge position in the plug circumferential direction can be more easily identified.

Other working effects are similar to those according to the second embodiment.

Fourth Embodiment

Figure 19:
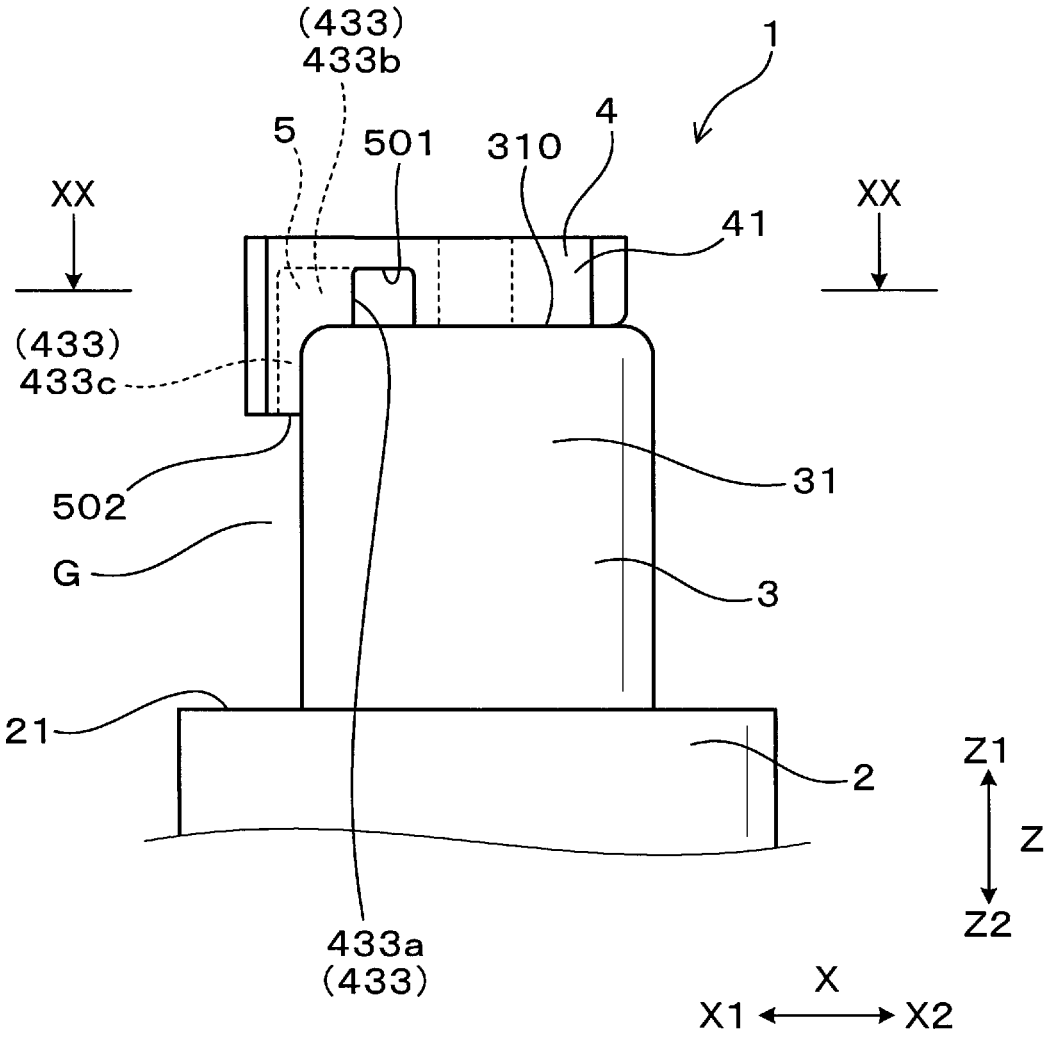
FIG. 19 is a front view of the distal end portion of the spark plug according to a fourth embodiment.
Figure 20:
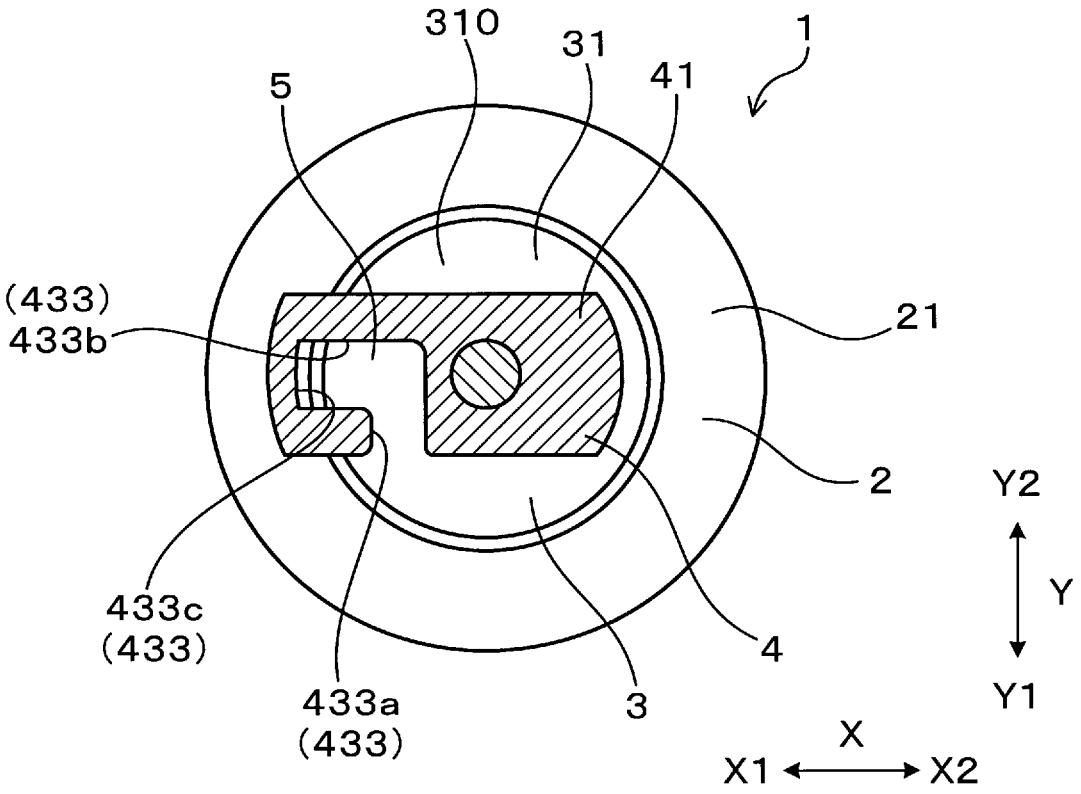
FIG. 20 is a cross-sectional view taken along line XX-XX in FIG. 19.

According to a fourth embodiment, as shown in FIG. 19 and FIG. 20, a manner in which the communication passage 5 is formed is changed from that according to the first embodiment.

According to the present embodiment, the insulator groove portion (refer to reference number 311 in FIG. 2 and the like) described according to the first embodiment is not formed. That is, the distal end surface 310 and the outer circumferential surface of the insulator protruding portion 31 are formed such as to be flat. In addition, according to the present embodiment, the communication passage 5 is formed by being surrounded by the electrode groove portion 433 and the surface of the insulator protruding portion 31. The flow inlet 501 is formed such as to be surrounded by the first electrode groove 433*a* and the distal end surface 310 of the insulator protruding portion 31. The flow outlet 502 is formed such as to be surrounded by the third electrode groove 433*c* and the outer circumferential surface of the insulator protruding portion 31, in a manner similar to that according to the first embodiment.

Other configurations are similar to those according to the first embodiment.

According to the present embodiment, the insulator 3 is not required to be specially processed when the communication passage 5 is formed. Therefore, the communication passage 5 can be easily formed.

Other working effects are similar to those according to the first embodiment.

Fifth Embodiment

Figure 21:
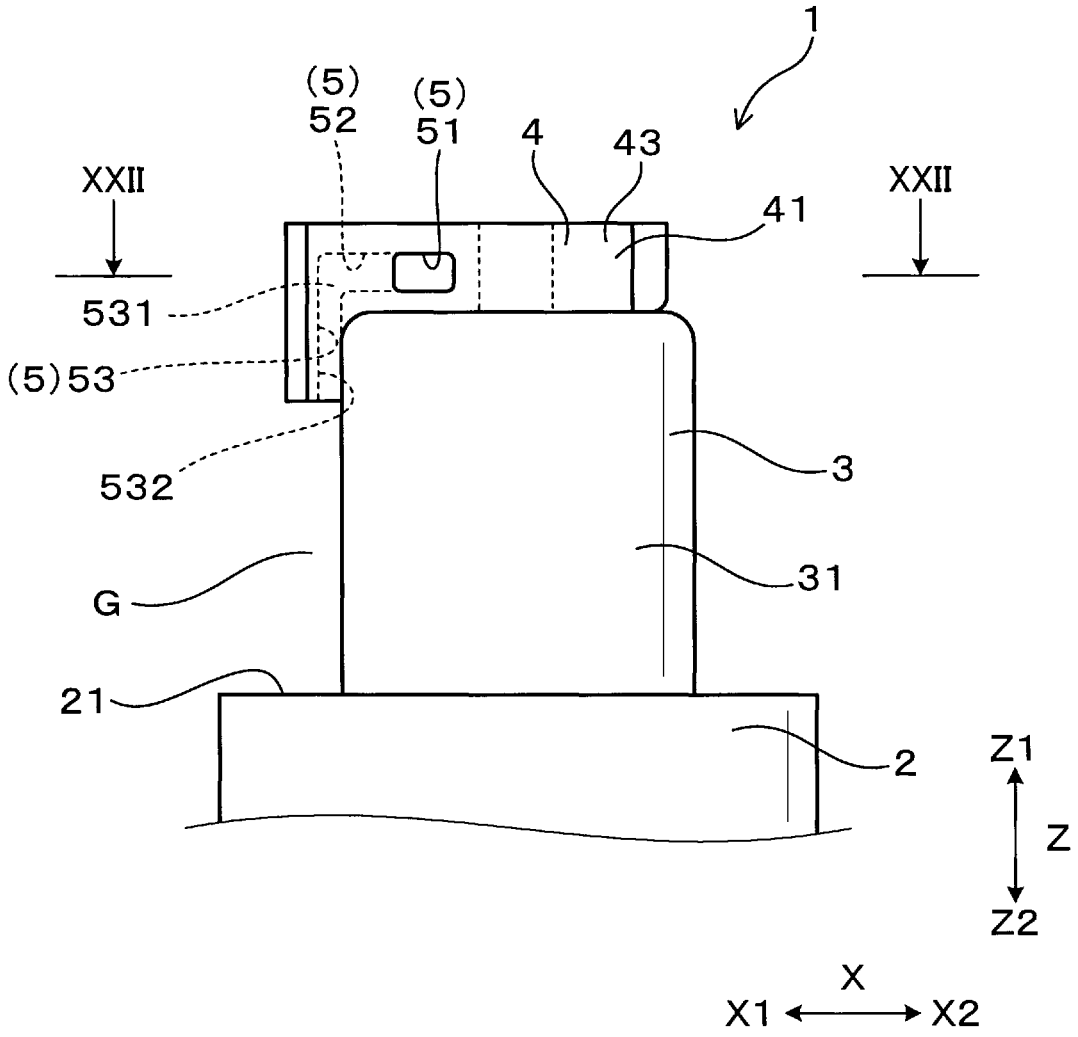
FIG. 21 is a front view of the distal end portion of the spark plug according to a fifth embodiment.
Figure 22:
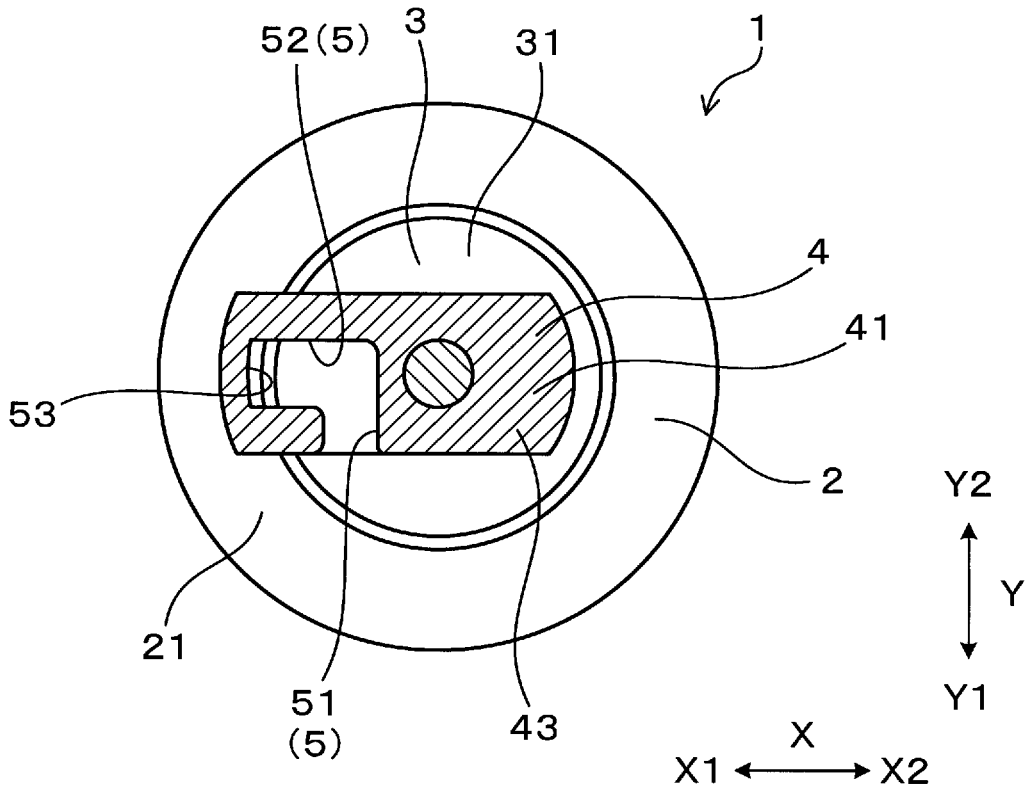
FIG. 22 is a cross-sectional view taken along line XXII-XXII in FIG. 21.

According to a fifth embodiment, as shown in FIG. 21 and FIG. 22, the manner in which the communication passage 5 is formed is changed from that according to the fourth embodiment.

According to the present embodiment, at least a portion of the communication passage 5 is formed by a hole that is formed in the attached member 43 of the center electrode 4. According to the present embodiment, the communication passage 5 is configured by the first path 51, the second path 52, and the third path 53. The first path 51, the second path 52, and a portion of the third path 53 are formed by the hole.

The overall first path 51 is on an inner side of a hole that is formed in the first portion 431 in the vertical direction Y. That is, the first path 51 is surrounded by the first portion 431 in all directions perpendicular to the vertical direction Y that is a formation direction of the first path 51. A Y1-side end portion of the first path 51 is open on the Y1 side. The opening configures the flow inlet 501. In addition, a Y2-side end portion of the first path 51 is closed.

The second path 52 is on an inner side of a hole that is formed in the first portion 431 in the lateral direction X. The second path 52 is formed from the Y2-side end portion of the first path 51 toward the X1 side. That is, the second path 52 is surrounded by the first portion 431 in all directions perpendicular to the lateral direction X that is a formation direction of the second path 52.

In addition, as shown in FIG. 21, the third path 53 is on an inner side of a hole 531 that is formed on the Z1 side and a groove 532 that is formed on the Z2 side in the second portion 432. The third path 53 is configured by the hole 531 that is formed from the X1-side end portion of the second path 52 toward the Z2 side and the groove 532 is formed from a Z2-side end portion of the hole in the third path 53 toward the Z2 side. The groove 532 of the third path 53 is formed such that the surface on the X2 side is recessed toward the X1 side. The X2 side of the groove 532 of the third path 53 is closed by the surface of the insulator protruding portion 31. A Z2-side end portion of the groove 532 of the third path 53 is open on the Z2 side in the plug axial direction Z. The opening configures the flow outlet 502.

Other configurations are similar to those according to the fourth embodiment.

According to the present embodiment, even when the communication passage 5 is formed in the center electrode 4, strength of the center electrode 4 can be easily ensured. Other working effects are similar to those according to the fourth embodiment.

Sixth Embodiment

According to a sixth embodiment, as shown in FIG. 23 to FIG. 26, the manner in which the communication passage 5 is formed is changed from that according to the first embodiment.

Figure 23:
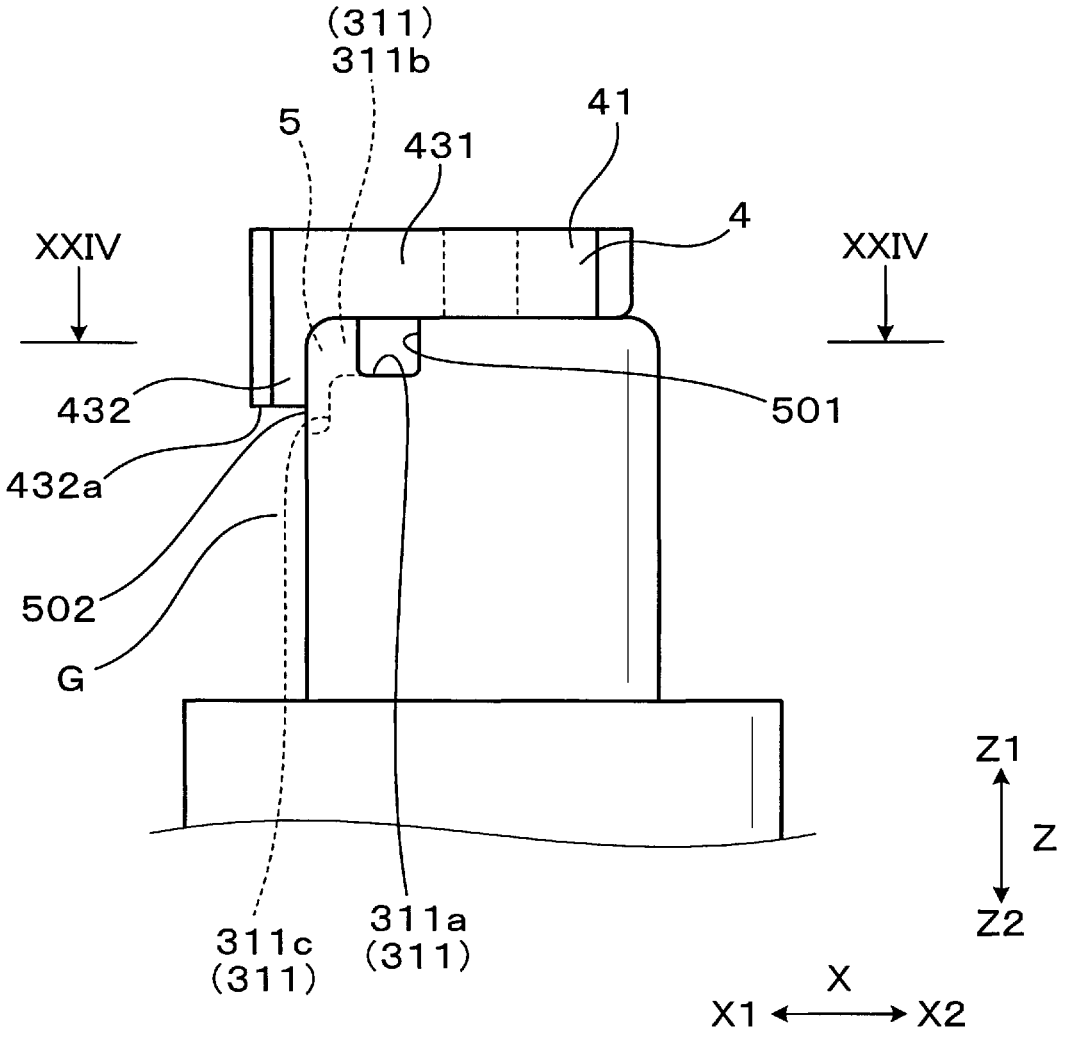
FIG. 23 is a front view of the distal end portion of the spark plug according to a sixth embodiment.
Figure 24:
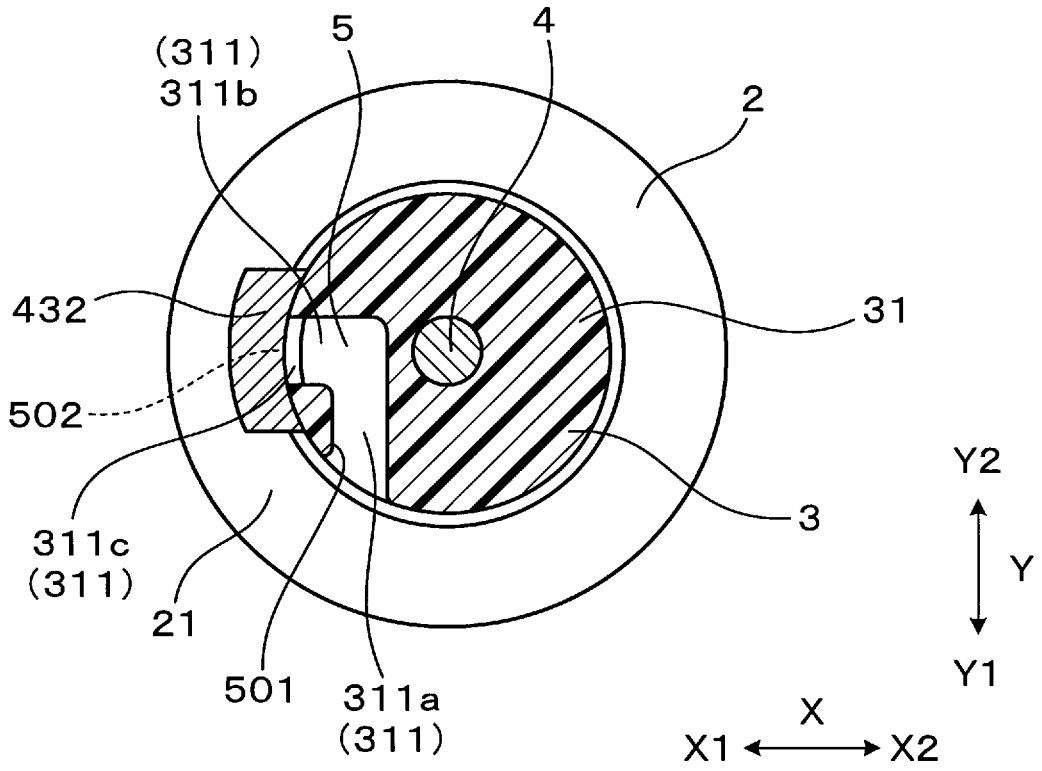
FIG. 24 is a cross-sectional view taken along line XXIV-XXIV in FIG. 23.

According to the present embodiment, the electrode groove portion (refer to reference number 433 in FIG. 2 and the like) described according to the first embodiment is not formed. That is, as shown in FIG. 23, the Z2-side end surface of the first portion 431 of the exposed portion 41 and the surface of the second portion 432 on the X1 side are formed such as to be flat. In addition, according to the present embodiment, the communication passage 5 is formed such as to be surrounded by the insulator groove portion 311 and the surface of the exposed portion 41 of the center electrode 4.

Figure 25:
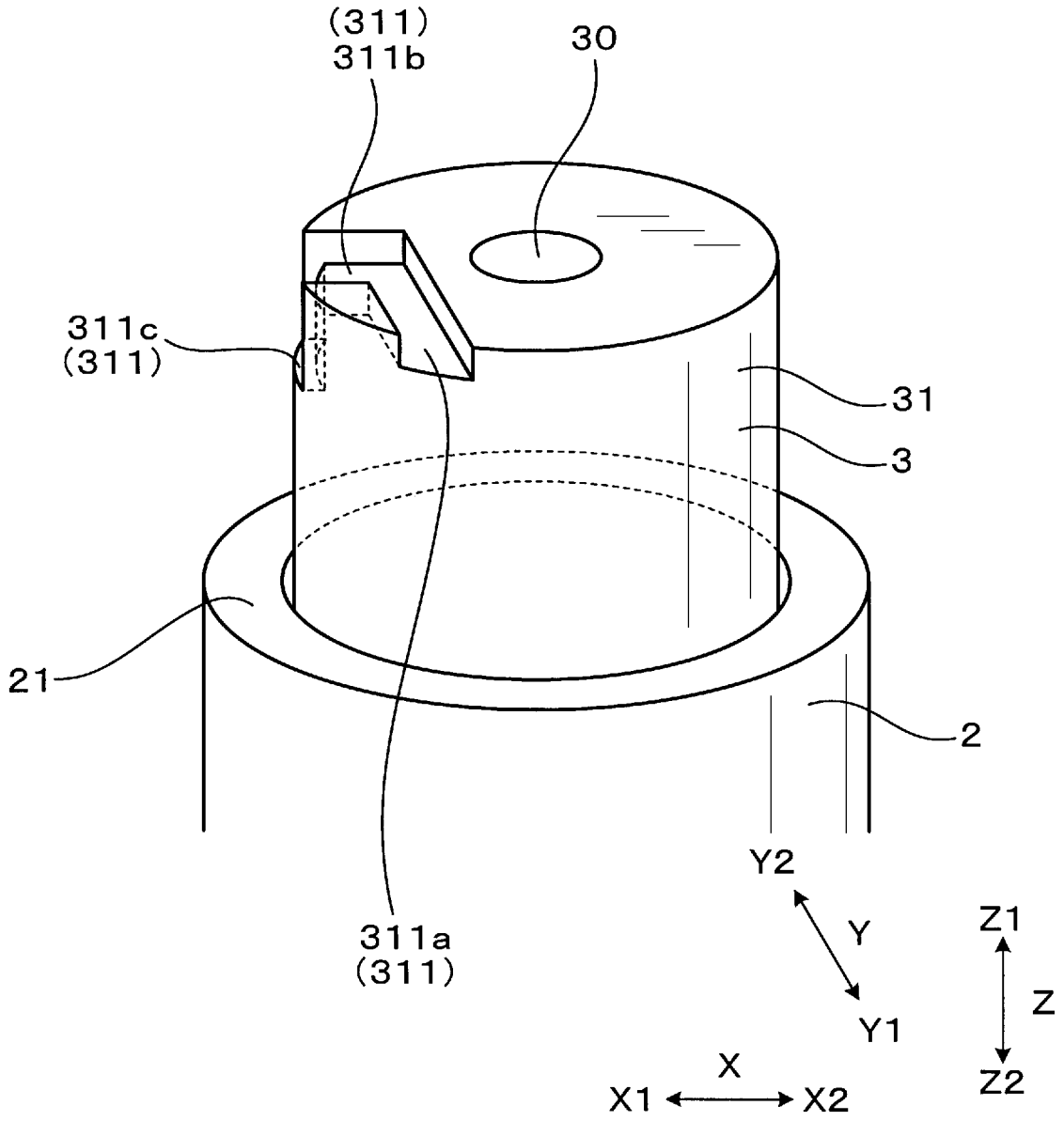
FIG. 25 is a perspective view of the ground electrode and the insulator according to the sixth embodiment.
Figure 26:
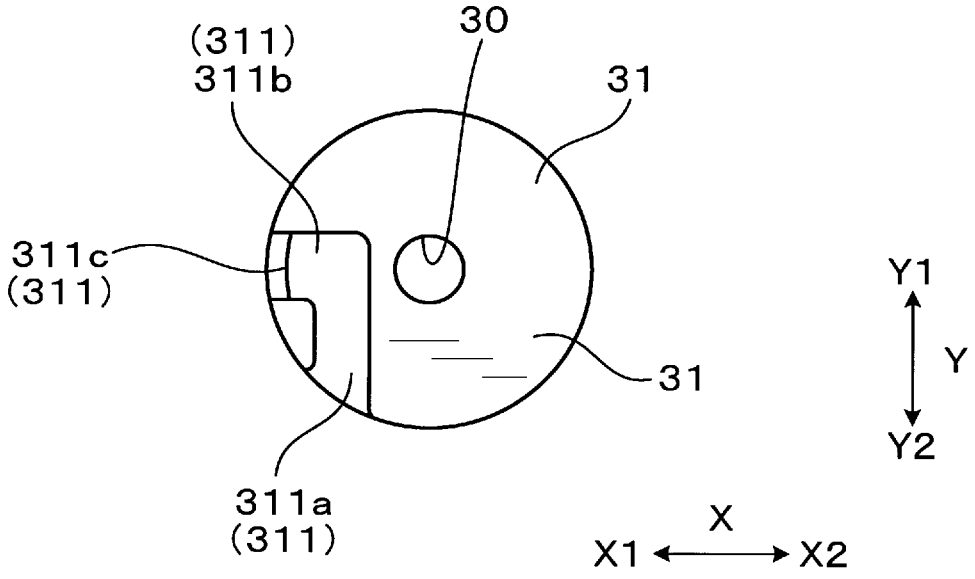
FIG. 26 is a plan view of the insulator according to the sixth embodiment.

As shown in FIG. 25 and FIG. 26, according to the present embodiment, the insulator groove portion 311 includes a third insulator groove 311*c* in addition to the first insulator groove 311*a* and the second insulator groove 311*b* described according to the first embodiment. The third insulator groove 311*c* is formed toward a lower side from an X1-side end portion of the second insulator groove 311*b*. The third insulator groove 311*c* is formed into a groove shape in which the outer circumferential surface of the insulator protruding portion 31 is recessed toward the inner circumferential side in the plug radial direction.

The first insulator groove 311*a* is closed on the Z1 side by the surface of the first portion 431 on the Z2 side, excluding the Y1-side end portion thereof. In addition, the flow inlet 501 is formed such as to be surrounded by the first insulator groove 311*a* and the surface of the first portion 431 on the Z2 side.

As shown in FIG. 23, the second insulator groove 311*b* is closed from the X1 side by the second portion 432 of the exposed portion 41.

The Z1-side end portion of the third insulator groove 311*c* is closed from the X1 side by the second portion 432. Meanwhile, the Z2-side end portion of the third insulator groove 311*c* protrudes further toward the Z2 side than the Z2-side end surface 432 of the second portion 432, and is open on the outer circumferential side in the plug radial direction, thereby configuring the flow outlet 502. The flow outlet 502 is open toward the discharge gap G, on the outer circumferential side in the plug radial direction.

Other configurations are similar to those according to the first embodiment.

According to the present embodiment, the center electrode 4 is not required to be specially processed when the communication passage 5 is formed. Therefore, the communication passage 5 can be easily formed.

In addition, according to the present embodiment, the flow outlet 502 is open toward the outer circumferential side in the plug radial direction. Therefore, the specific airflow F2 that flows out from the flow outlet 502 flows toward the outer circumferential side in the plug radial direction. As a result, an initial discharge spark that is present along the outer circumferential surface of the insulator protruding portion 31 can be easily separated from the outer circumferential surface of the insulator protruding portion 31 by the specific airflow F2 that flows out from the flow outlet 501 toward the outer circumferential side in the plug radial direction.

Other working effects are similar to those according to the first embodiment.

Seventh Embodiment

Figure 27:
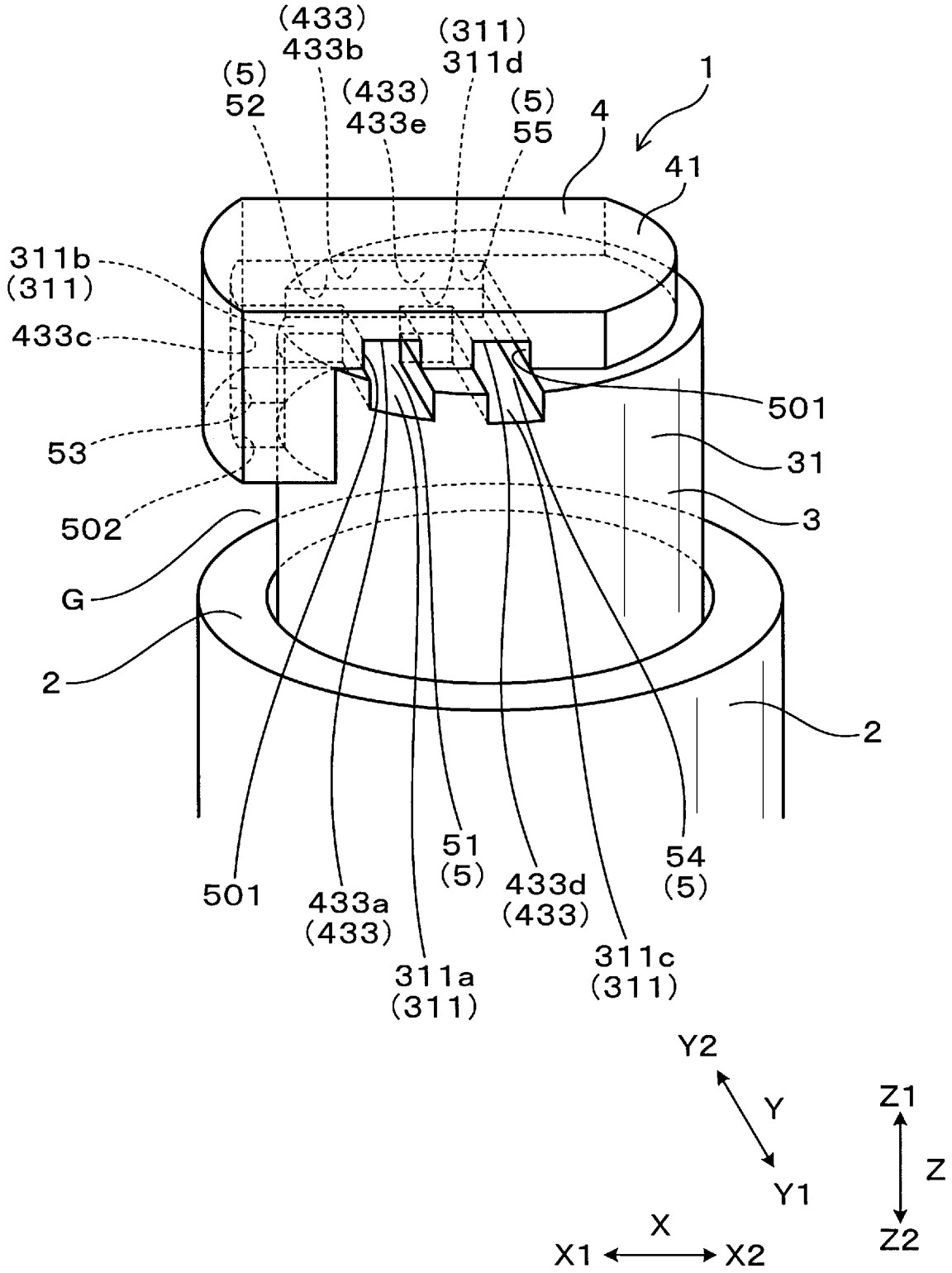
FIG. 27 is a perspective view of the distal end portion of the spark plug according to a seventh embodiment.

According to a seventh embodiment, as shown in FIG. 27, the flow inlet 501 is formed in two locations in the configuration according to the first embodiment.

According to the present embodiment, the insulator groove portion 311 includes the third insulator groove 311*c* and a fourth insulator groove 311*d*, in addition to the first insulator groove 311*a* and the second insulator groove 311*b* that are similar to those according to the first embodiment. The third insulator groove 311*c* is formed in the vertical direction Y in a position that is slightly at a distance toward the X2 side of the first insulator groove 311*a*. The third insulator groove 311*c* is open on the Y1 side. The fourth insulator groove 311*d* communicates between a Y2-side end portion of the third insulator groove 311*c* and the Y2-side end portion of the first insulator groove 311*a* in the lateral direction X.

In addition, the electrode groove portion 433 includes a fourth electrode groove 433*d* and a fifth electrode groove 433*e*, in addition to the first electrode groove 433*a*, the second electrode groove 433*b*, and the third electrode groove 433*c* that are similar to those according to the first embodiment.

The fourth electrode groove 433*d* is formed in a position that overlaps the third insulator groove 311*c* in the plug axial direction Z. The fourth electrode groove 433*d* is formed in the vertical direction Y and open on the Y1 side. The opening portion of the fourth electrode groove 433*d* on the Y1 side is formed in a position that is offset further toward the Y2 side than the opening portion of the third insulator groove 311*c* on the Y1 side.

The fifth electrode groove 433*e* is formed in a position that overlaps the fourth insulator groove 311*d* in the plug axial direction Z. The fifth electrode groove 433*e* is formed such as to communicate between a Y2-side end portion of the fourth electrode groove 433*d* and the Y2-side end portion of the first electrode groove 433*a* in the lateral direction X.

According to the present embodiment, the communication passage 5 includes the fourth path 54 and a fifth path 55, in addition to the first path 51, the second path 52, and the third path 53 that are described according to the first embodiment. The fourth path 54 is surrounded by the fourth electrode groove 433*d* and the third insulator groove 311*c*. A second flow inlet 5-1 that is separate from the flow inlet 501 that is formed on the X1 side of the first path 51 is formed on the Y1 side of the fourth path 54. According to the present embodiment, the two flow inlets 501 of the communication passage 5 are both open toward the upstream side of the main flow F1 of the air-fuel mixture, that is, toward the Y1 side.

The fifth path 55 is surrounded by the fifth electrode groove 433*e* and the fourth insulator groove 311*d*. An end portion of the fifth path 55 on the X2 side communicates with the fourth path 54. An end portion of the fifth path 55 on the X1 side communicates with the end portion of the first path 51 on the Y2 side and the end portion of the second path 52 on the X2 side.

According to the present embodiment as well, the area of the flow outlet 502 is smaller than the area of the flow inlet 501. When a plurality of flow inlets 501 are provided as according to the present embodiment, the area of the flow inlet 501 refers to a sum of the areas of the plurality of flow inlets 501. In addition, should a plurality of flow outlets 502 be provided, the area of the flow outlet 502 refers to a sum of the areas of the plurality of flow outlets 502.

Other configurations of the flow inlet 501 formed in the fourth path 54 are similar to those of the flow inlet 501 formed in the first path 51. In addition, configurations of the spark plug 1 other than those described above are similar to those according to the first embodiment.

According to the present embodiment, the plurality of flow inlets 501 that are open on the same side are provided. Therefore, a flow amount of the airflow that flows into the communication passage 5 can be ensured. As a result, a speed of airflow that is discharged from the flow outlet 502 is easily increased. Consequently, the discharge spark can be pulled away from the outer circumferential surface of the insulator protruding portion 31 at an earlier stage.

Other working effects are similar to those according to the first embodiment.

Eighth Embodiment

Figure 28:
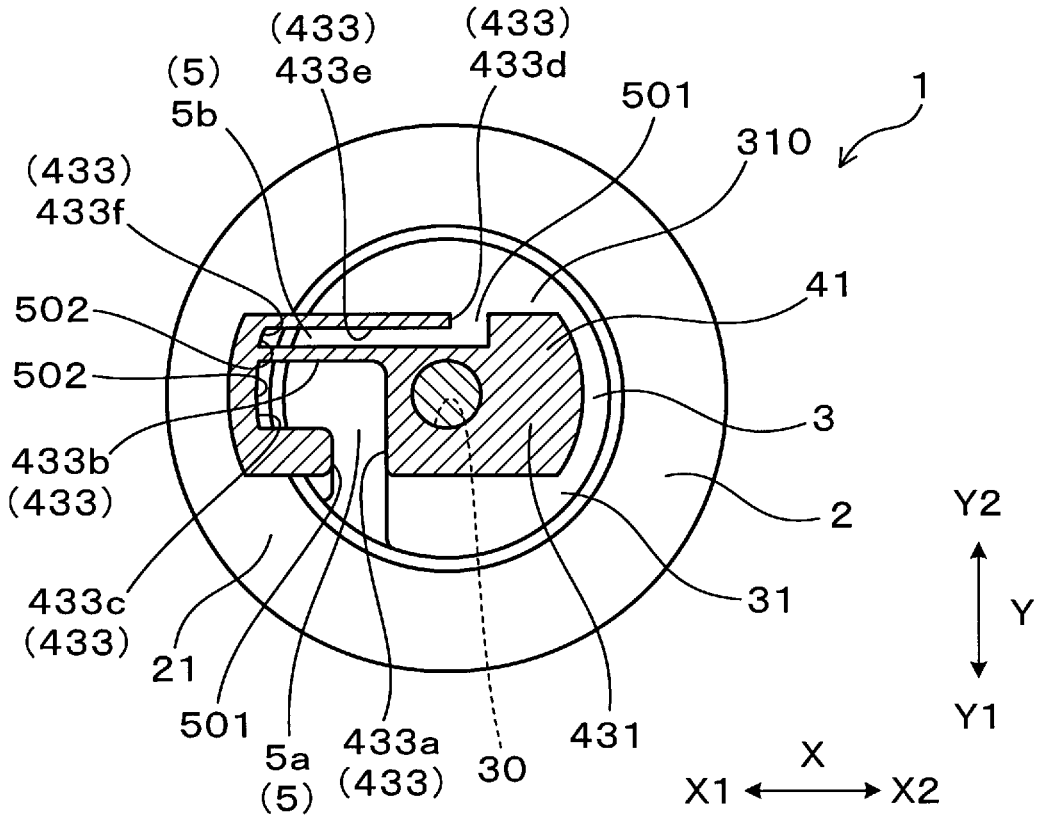
FIG. 28 is a cross-sectional view of the spark plug according to an eighth embodiment, the cross-section being perpendicular to a plug axial direction and passing through an electrode groove portion.

According to an eighth embodiment, as shown in FIG. 28, a plurality of communication passages 5 are configured.

According to the present embodiment, the electrode groove portion 433 includes the fourth electrode groove 433*d*, the fifth electrode groove 433*e*, and a sixth electrode groove 433*f*, in addition to the first electrode groove 433*a*, the second electrode groove 433*b*, and the third electrode groove 433*c* that are similar to those according to the first embodiment. The fourth electrode groove 433*d*, the fifth electrode groove 433*e*, and the sixth electrode groove 433*f* are continuously formed. The fourth electrode groove 433*d* and the fifth electrode groove 433*e* are formed into groove shapes in which the Z2-side end surface of the first portion 431 of the exposed portion 41 is recessed toward the Z1 side. The sixth electrode groove 433*f* is formed into a groove shape in which the surface of the second portion 432 on the X2 side is recessed toward the X1 side.

The fourth electrode groove 433*d* is formed on the Y2 side of the shaft hole 30 in the vertical direction Y. The fourth electrode groove 433*d* is formed in the vertical direction Y and is open on the Y2 side. The fourth electrode groove 433*d* is closed on the Z2 side by the distal end surface 310 of the insulator protruding portion 31.

The fifth electrode groove 433*e* is formed on the X1 side from an end portion of the fourth electrode groove 433*d* on the Y1 side. The fifth electrode groove 433*e* is formed such that an X1-side end portion protrudes further toward the X1 side than the distal end surface 310 of the insulator protruding portion 31. Portions of the fifth electrode groove 433*e* excluding the X1-side end portion are closed by the distal end surface 310 of the insulator protruding portion 31. In addition, the fifth electrode groove 433 is formed on the Y2 side of the second electrode groove 433*b*.

The sixth electrode groove 433*f* extends toward the Z2 side in the plug axial direction Z from the X1-side end portion of the fifth electrode groove 433*e*. The sixth electrode groove 433*f* is open on the Z2 side in the plug axial direction Z. The sixth electrode groove 433*f* is open toward the discharge gap G. The sixth electrode groove 433*f* is closed from the X2 side by the outer circumferential surface of the insulator protruding portion 31. In addition, the sixth electrode groove 433*f* is formed on the Y2 side of the third electrode groove 433*c*.

Furthermore, according to the present embodiment, a second communication passage 5*b* is formed in addition to a first communication passage 5*a* that is the communication passage 5 described according to the first embodiment. The second communication passage 5*b* is surrounded by the fourth electrode groove 433*d*, the fifth electrode groove 433*e*, the sixth electrode groove 433*f*, and the surface of the insulator protruding portion 31.

The flow inlet 501 that is open on the Y2 side is formed on the Y2 side of an area of the second communication passage 5*b* that is surrounded by the fourth electrode groove 433*d* and the distal end surface 310 of the insulator protruding portion 31. The flow inlet 501 is open toward a side opposite the flow inlet 501 of the first communication passage 5*a*. That is, the flow inlet 501 of the second communication passage 5*b* is open toward the downstream side, that is, the Y2 side. The overall circumference of the flow inlet 501 is surrounded by the fourth electrode groove 433*d* and the distal end surface 310 of the insulator protruding portion 31.

In addition, the flow outlet 502 that is open on the Z2 side in the plug axial direction Z is formed in an area of the second communication passage 5*b* on the Z2 side in the plug axial direction Z that is surrounded by the sixth electrode groove 433*f* and the outer circumferential surface of the insulator protruding portion 31. The flow outlet 502 of the second communication passage 5*b* is positioned on the Y2 side of the flow outlet 502 of the first communication passage 5*a*. The flow outlet 502 of the second communication passage 5*b* is open toward the discharge gap G. The overall circumference of the flow outlet 502 of the second communication passage 5*b* is surrounded by the sixth electrode groove 433*f* and the outer circumferential surface of the insulator protruding portion 31.

Other configurations of the second communication passage 5*b* are similar to those of the first communication passage 5*a*. In addition, other configurations are similar to those according to the first embodiment.

According to the present embodiment, two communication passages 5 are provided. The respective flow inlets 501 of the two communication passages 5 are open on opposite sides. Therefore, when the spark plug 1 is arranged at an attitude at which one of the flow inlets 501 of the two communication passages 5 faces the upstream side of the main flow of the air-fuel mixture, that is, the Y1 side, airflow flows into the communication passage 5 from the flow inlet 501 that is facing the upstream side. Therefore, a degree of freedom regarding the attachment attitude of the spark plug 1 in relation to the engine head 12 is improved.

Other working effects are similar to those according to the first embodiment.

Ninth Embodiment

Figure 29:
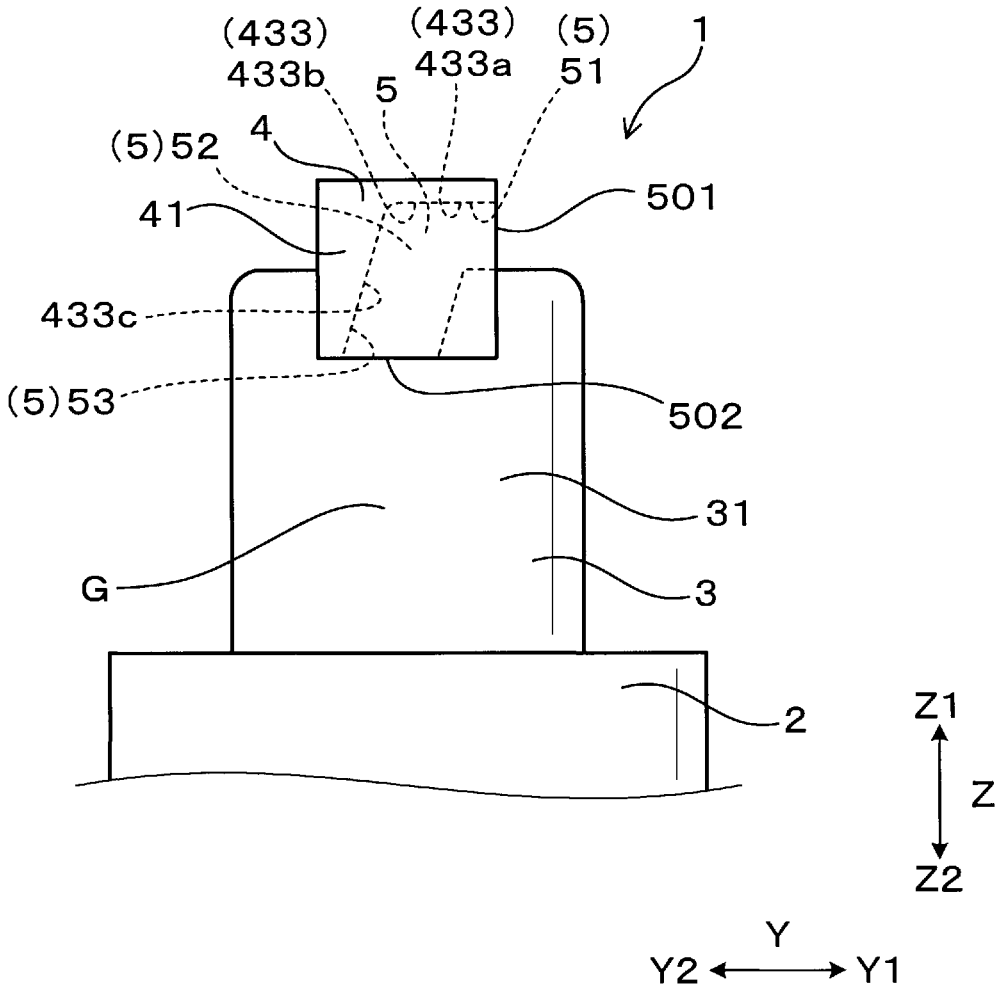
FIG. 29 is a side view of the distal end portion of the spark plug according to a ninth embodiment.
Figure 30:
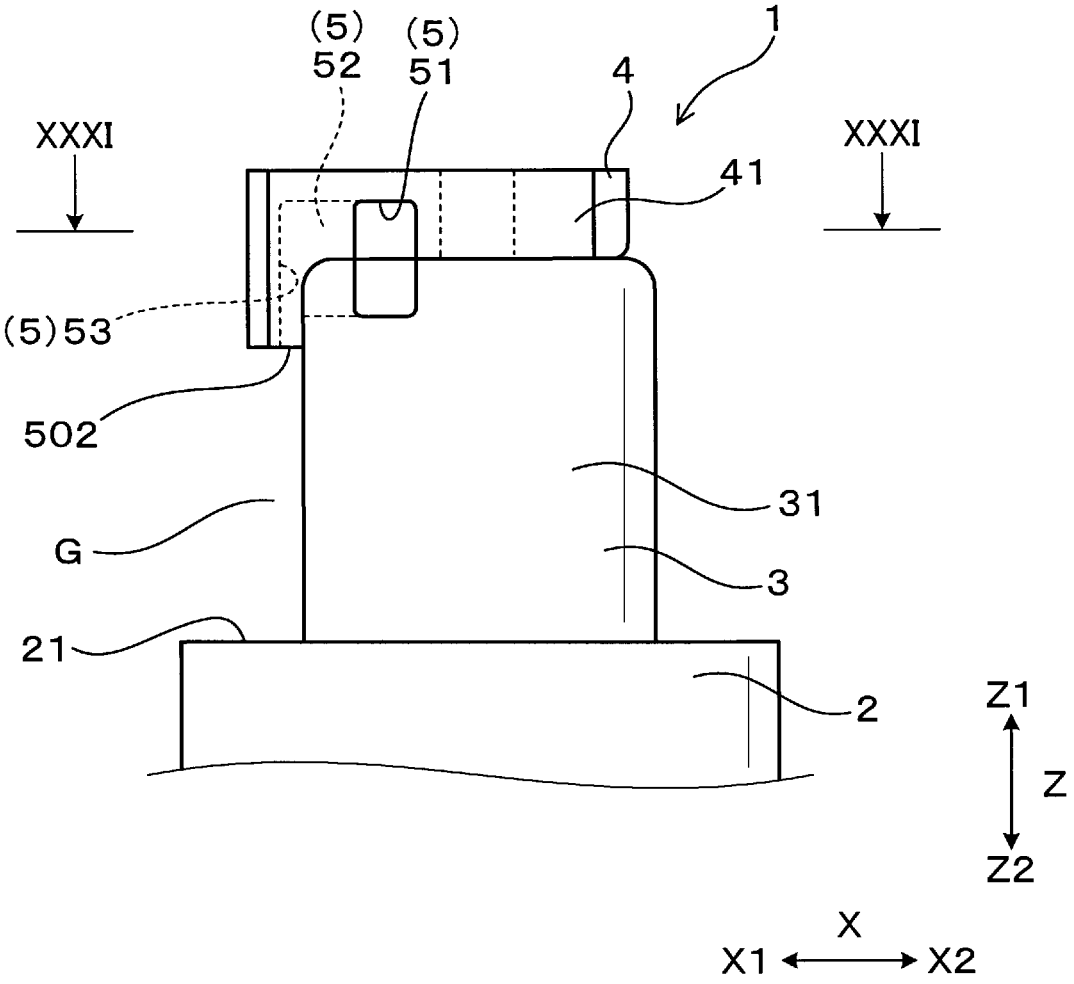
FIG. 30 is a front view the distal end portion of the spark plug according to the ninth embodiment.
Figure 31:
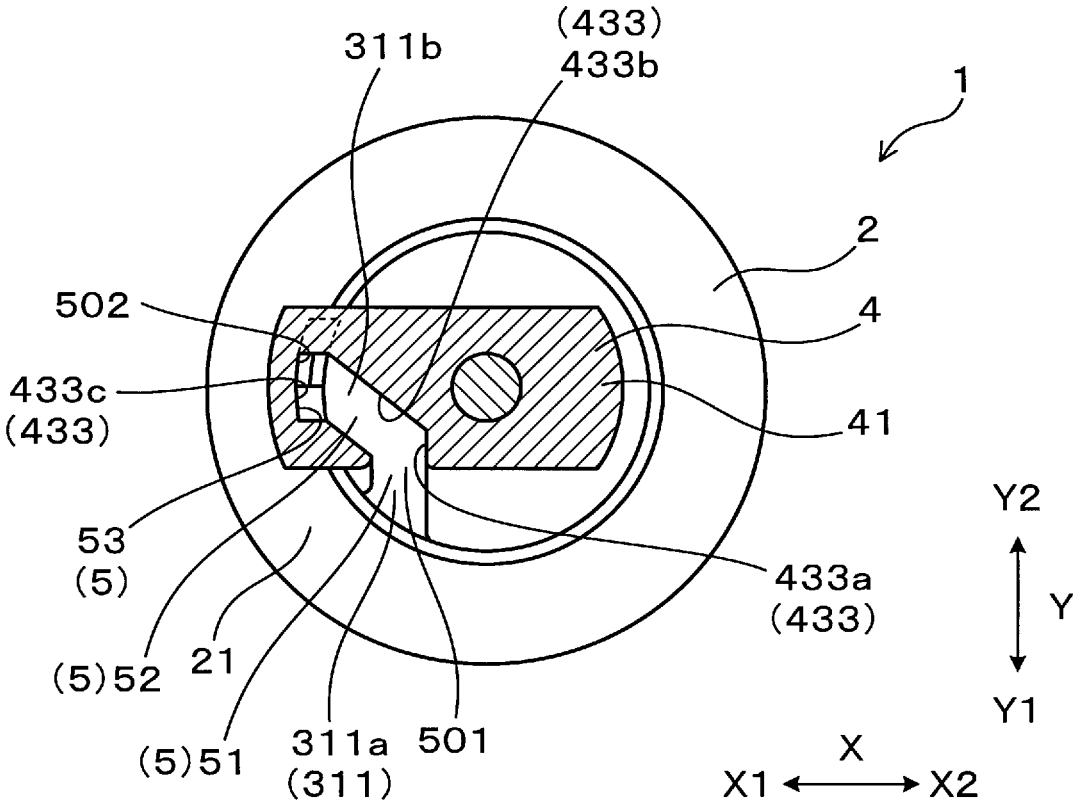
FIG. 31 is a cross-sectional view taken along line XXXI-XXXI in FIG. 30.

According to a ninth embodiment, as shown in FIG. 29 to FIG. 31, the shape of the communication passage is changed from that according to the first embodiment. Here, in FIG. 29, a contour of the electrode groove portion 433 is shown by broken lines. A contour of the insulator groove portion 311*a* is omitted.

As shown in FIG. 31, the insulator groove portion 311 includes the first insulator groove 311*a* and the second insulator groove 311*b*. The first insulator groove 311*a* is formed in the vertical direction Y and is open on the Y1 side. The second insulator groove 311*b* extends from the Y2-side end portion of the first insulator groove 311*a*. In addition, the second insulator groove 311*b* is formed such as to slope toward the X1 side, toward the Y2 side. The end portion of the second insulator groove 311*b* on the side opposite the first insulator groove 311*a* is open on the X2 side.

In addition, the electrode groove portion 433 includes the first electrode groove 433*a*, the second electrode groove 433*b*, and the third electrode groove 433*c*. The first electrode groove 433*a* is formed in the vertical direction Y and is open on the Y1 side. The first electrode groove 433*a* is formed in a position that overlaps the first insulator groove 311*a* in the plug axial direction Z. The opening portion of the first electrode groove 433*a* on the Y1 side is formed in a position that is offset further toward the Y2 side than the opening portion of the first insulator groove 311*a* on the Y1 side.

The second electrode groove 433*b* extends from the Y2-side end portion of the first electrode groove 433*a*. In addition, the second electrode groove 433*b* is formed such as to slope toward the X1 side, toward the Y2 side. The second electrode groove 433*b* is formed in a position that overlaps the second insulator groove 311*b* in the plug axial direction Z. The end portion of the second electrode groove 433*b* on the side opposite the first electrode groove 433*a* side is formed such as to protrude further toward the X1 side than the distal end surface 310 of the insulator protruding portion 31.

The third electrode groove 433*c* extends from the end portion of the second electrode groove 433*b* on the side opposite the first electrode groove 433*a* side. As shown in FIG. 29, the third electrode groove 433*c* slopes toward the Y2 side in the vertical direction, toward the Z2 side in the plug axial direction Z. A Z2-side end portion of the third electrode groove 433*c* is open on the Z2 side in the plug axial direction Z. The third electrode groove 433*c* is open toward the discharge gap G.

According to the present embodiment, the communication passage 5 is configured by an area that is surrounded by the electrode groove portion 433 and the insulator groove portion 311, and an area that is surrounded by the electrode groove portion 433 and the outer circumferential surface of the insulator protruding portion 31. The communication passage 5 includes the first path 51, the second path 52, and the third path 53. The first path 51 is surrounded by the first electrode groove 433*a* and the first insulator groove 311*a*. The second path 52 is surrounded by the second electrode groove 433*b* and the second insulator groove 311*b*. The third path 53 is surrounded by the third electrode groove 433*c* and the outer circumferential surface of the insulator protruding portion 31.

As shown in FIG. 29 and FIG. 31, the first path 51 is formed in the vertical direction Y. The flow inlet 501 that is open on the Y1 side is formed on the Y1 side of the first path 51.

As shown in FIG. 31, the second path 52 is sloped toward the X1 side, toward the downstream side of the main flow of the air-fuel mixture, that is, the Y2 side. The second path 52 is sloped in relation to the flow direction of the main flow of the air-fuel mixture, that is, the vertical direction Y. In addition, the second path 52 is also sloped in relation to the plug axial direction Z. One end of the second path 52 communicates with the first path 51. The other end of the second path 52 communicates with the third path 53.

The third path 53 is sloped toward the Z2 side, toward the downstream side of the main flow of the air-fuel mixture, that is, the Y2 side. The third path 53 is sloped in relation to the flow direction of the main flow of the air-fuel mixture, that is, the vertical direction Y. In addition, the third path 53 is also sloped in relation to the plug axial direction Z. The end portion of the third path 53 on the side opposite the second path 52 configures the flow outlet 502 that is open toward the Z2 side in the plug axial direction.

Other configurations are similar to those according to the first embodiment.

According to the preset embodiment, the communication passage 5 includes a portion (that is, the second path 52 and the third path 53) that is sloped toward a direction that is perpendicular to the flow direction of the main flow of the air-fuel mixture, toward the downstream side in the flow direction. Therefore, the flow of air-fuel mixture inside the communication passage 5 can be changed without the flow of air-fuel mixture flowing into the communication passage 5 being significantly obstructed.

In addition, according to the present embodiment, the communication passage 5 is configured by a portion that is formed in the flow direction of the main flow of the air-fuel mixture and a portion that is formed in a direction that is sloped in relation to the flow direction of the main flow. Therefore, the specific airflow that passes through the communication passage 5 can easily smoothly pass through the communication passage 5. Consequently, the airflow can be easily introduced into the communication passage 5 and discharged from inside the communication passage 5.

The present disclosure is not limited to the embodiments described above and can be applied to various embodiments without departing from the spirit of the invention. For example, in the above-described embodiments, an example in which the second portion covers a portion of the outer circumferential surface of the insulator protruding portion from the outer circumferential side in the plug radial direction is given. However, the present disclosure is not limited thereto. The second portion may cover the overall circumference of the outer circumferential surface of the insulator protruding portion.

What is claimed is:

1. A spark plug for an internal combustion engine, the spark plug comprising:

a cylindrical ground electrode;

a cylindrical insulator that is arranged radially inside the ground electrode and includes an insulator protruding portion that protrudes further toward a distal end side in a plug axial direction than a distal end of the ground electrode; and a center electrode that is held radially inside the insulator and includes an exposed portion that is exposed from a distal end of the insulator protruding portion, the spark plug being configured to generate a discharge from the exposed portion of the center electrode to the ground electrode, in a discharge gap that is formed along a surface of the insulator protruding portion, and at least one of the exposed portion and the insulator protruding portion comprising a flow inlet that penetrates on an outer circumferential surface of the at least one of the exposed portion and the insulator protruding portion, a flow outlet that is open toward the discharge gap, and a communication passage that communicates between the flow inlet and the flow outlet;

wherein in a state in which the spark plug is attached to the internal combustion engine, when viewed from the plug axial direction, a virtual straight line that passes through the flow outlet and a plug center shaft is perpendicular to a flow direction of a main flow of an air-fuel mixture that passes through a distal end portion of the spark plug.

2. The spark plug for an internal combustion engine according to claim 1, wherein:

in the state in which the spark plug is attached to the internal combustion engine, the flow inlet is open toward an upstream side of a main flow of an air-fuel mixture that passes through the distal end portion of the spark plug.

3. The spark plug for an internal combustion engine according to claim 1, wherein:

the ground electrode comprises a ground electrode protruding portion that protrudes toward the distal end side in the plug axial direction and forms the discharge gap with the exposed portion.

4. The spark plug for an internal combustion engine according to claim 3, wherein:

the ground electrode protruding portion has a thickness in a plug radial direction that decreases toward the distal end side in the plug axial direction.

5. The spark plug for an internal combustion engine according to claim 1, wherein:

the exposed portion comprises a first portion that covers the insulator protruding portion from the distal end side in the plug axial direction, and a second portion that extends toward a proximal end side in the plug axial direction from the first portion and covers at least a portion of an outer circumferential surface of the insulator protruding portion from an outer circumferential side in a plug radial direction.

6. The spark plug for an internal combustion engine according to claim 1, wherein:

at least one of the exposed portion and the insulator protruding portion has at least one of a groove or a hole formed therein, the communication passage comprising at least one of the groove or the hole.

7. The spark plug for an internal combustion engine according to claim 6, wherein:

one of the exposed portion and the insulator protruding portion has at least one of the groove or the hole formed therein, the communication passage comprising at least one of the groove or the hole.

8. The spark plug for an internal combustion engine according to claim 1, wherein:

the flow inlet comprises a plurality of flow inlets that are open on opposite sides;

the communication passage comprises a plurality of communication passages; and each of the plurality of the communication passages communicate with a respective flow inlet.

9. The spark plug for an internal combustion engine according to claim 1, wherein:

in the state in which the spark plug is attached to the internal combustion engine, the flow inlet is open toward an intake valve side of the internal combustion engine.

10. The spark plug for an internal combustion engine according to claim 1, wherein:

in the state in which the spark plug is attached to the internal combustion engine, when viewed from the plug axial direction, a virtual straight line that passes through the flow outlet and the plug center shaft is perpendicular to a straight line connecting an intake valve and an exhaust valve provided in the internal combustion engine.

11. A spark plug for an internal combustion engine, the spark plug comprising:

a cylindrical ground electrode;

a cylindrical insulator that is arranged radially inside the ground electrode and includes an insulator protruding portion that protrudes further toward a distal end side in a plug axial direction than a distal end of the ground electrode; and a center electrode that is held radially inside the insulator and includes an exposed portion that is exposed from a distal end of the insulator protruding portion, the spark plug being configured to generate a discharge from the exposed portion of the center electrode to the ground electrode, in a discharge gap that is formed along a surface of the insulator protruding portion, and at least one of the exposed portion and the insulator protruding portion comprising a flow inlet that penetrates on an outer circumferential surface of the at least one of the exposed portion and the insulator protruding portion, a flow outlet that is open toward the discharge gap, and a communication passage that communicates between the flow inlet and the flow outlet;

wherein an area of the flow outlet is smaller than an area of the flow inlet.

12. A spark plug for an internal combustion engine, the spark plug comprising:

a cylindrical ground electrode, a cylindrical insulator that is arranged radially inside the ground electrode and includes an insulator protruding portion that protrudes further toward a distal end side in a plug axial direction than a distal end of the ground electrode; and a center electrode that is held radially inside the insulator and includes an exposed portion that is exposed from a distal end of the insulator protruding portion, the spark plug being configured to generate a discharge from the exposed portion of the center electrode to the ground electrode, in a discharge gap that is formed along a surface of the insulator protruding portion, and at least one of the exposed portion and the insulator protruding portion comprising a flow inlet that penetrates on an outer circumferential surface of the at least one of the exposed portion and the insulator protruding portion, a flow outlet that is open toward the discharge gap, and a communication passage that communicates between the flow inlet and the flow outlet, wherein:

the flow inlet comprises a plurality of flow inlets that are open in a same side; and the communication passage communicates with each of the plurality of flow inlets.

13. A spark plug for an internal combustion engine, the spark plug comprising:

a cylindrical ground electrode;

a cylindrical insulator that is arranged radially inside the ground electrode and includes an insulator protruding portion that protrudes further toward a distal end side in a plug axial direction than a distal end of the ground electrode; and a center electrode that is held radially inside the insulator and includes an exposed portion that is exposed from a distal end of the insulator protruding portion, the spark plug being configured to generate a discharge from the exposed portion of the center electrode to the ground electrode, in a discharge gap that is formed along a surface of the insulator protruding portion, and at least one of the exposed portion and the insulator protruding portion comprising a flow inlet that penetrates on an outer circumferential surface of the at least one of the exposed portion and the insulator protruding portion, a flow outlet that is open toward the discharge gap, and a communication passage that communicates between the flow inlet and the flow outlet;

wherein in a state in which the spark plug is attached to the internal combustion engine, the communication passage comprises a portion that is sloped toward a direction, toward a downstream side of a flow direction of a main flow of an air-fuel mixture that passes through a distal end portion of the spark plug, the direction being perpendicular to the flow direction.

14. A spark plug for an internal combustion engine, the spark plug comprising:

a cylindrical ground electrode;

a cylindrical insulator that is arranged radially inside the ground electrode and includes an insulator protruding portion that protrudes further toward a distal end side in a plug axial direction than a distal end of the ground electrode; and a center electrode that is held radially inside the insulator and includes an exposed portion that is exposed from a distal end of the insulator protruding portion, the spark plug being configured to generate a discharge from the exposed portion of the center electrode to the ground electrode, in a discharge gap that is formed along a surface of the insulator protruding portion, and at least one of the exposed portion and the insulator protruding portion comprising a flow inlet that is open on an outer circumferential surface of the at least one of the exposed portion and the insulator protruding portion, a flow outlet that is open toward the discharge gap, and a communication passage that communicates between the flow inlet and the flow outlet;

wherein in a state in which the spark plug is attached to the internal combustion engine, when viewed from the plug axial direction, a virtual straight line that passes through the flow outlet and a plug center shaft is perpendicular to a flow direction of a main flow of an air-fuel mixture that passes through a distal end portion of the spark plug.

15. A spark plug for an internal combustion engine, the spark plug comprising:

a cylindrical ground electrode;

a cylindrical insulator that is arranged radially inside the ground electrode and includes an insulator protruding portion that protrudes further toward a distal end side in a plug axial direction than a distal end of the ground electrode; and a center electrode that is held radially inside the insulator and includes an exposed portion that is exposed from a distal end of the insulator protruding portion, the spark plug being configured to generate a discharge from the exposed portion of the center electrode to the ground electrode, in a discharge gap that is formed along a surface of the insulator protruding portion, and at least one of the exposed portion and the insulator protruding portion comprising a flow inlet that is open on an outer circumferential surface of the at least one of the exposed portion and the insulator protruding portion, a flow outlet that is open toward the discharge gap, and a communication passage that communicates between the flow inlet and the flow outlet;

wherein an area of the flow outlet is smaller than an area of the flow inlet.

* * * * *